US007082380B2

(12) United States Patent
Wiebe et al.

(10) Patent No.: US 7,082,380 B2
(45) Date of Patent: Jul. 25, 2006

(54) REFRIGERATION MONITOR

(76) Inventors: David Wiebe, 886 Leslie Drive, Victoria, BC (CA) V8X 2Y4; Phillip Smith, 2438 Dunlevy Street, Victoria, BC (CA) V8R 5Y9; Lawrence Johnson, 11080 Bond Boulevard, Delta, BC (CA) V4E 1M7

( * ) Notice: Subject to any disclaimer, the term of this patent is extended or adjusted under 35 U.S.C. 154(b) by 113 days.

(21) Appl. No.: 10/719,676

(22) Filed: Nov. 21, 2003

(65) Prior Publication Data

US 2004/0210419 A1 Oct. 21, 2004

Related U.S. Application Data

(60) Provisional application No. 60/428,237, filed on Nov. 22, 2002.

(51) Int. Cl.
*G06F 11/30* (2006.01)

(52) U.S. Cl. ..... 702/182

(58) Field of Classification Search ..... 702/182; 700/286; 62/212, 505, 196, 211, 160, 218, 62/135, 208; 236/51; 705/2; 713/320; 165/615
See application file for complete search history.

(56) References Cited

U.S. PATENT DOCUMENTS 3,555,251 A * 1/1971 Shavit ..... 700/286
4,090,371 A 5/1978 Keane
4,482,785 A 11/1984 Finnegan et al.
4,553,400 A 11/1985 Branz
4,612,775 A 9/1986 Branz et al.
4,787,213 A * 11/1988 Gras et al. ..... 62/212
4,848,096 A 7/1989 Funahashi et al.
5,009,075 A 4/1991 Okoren
5,044,168 A 9/1991 Wycoff
5,136,281 A 8/1992 Bonaquist
5,209,076 A 5/1993 Kauffman et al.
5,481,884 A 1/1996 Scoccia
5,586,445 A 12/1996 Bessler
5,596,507 A 1/1997 Jones et al.
5,934,087 A 8/1999 Watanabe et al.
6,205,798 B1 3/2001 Porter et al.
6,324,854 B1 12/2001 Jayanth
6,332,327 B1 12/2001 Street et al.
6,354,093 B1 3/2002 Davis et al.
6,430,944 B1 8/2002 Ozawa

* cited by examiner

*Primary Examiner*—John Barlow
*Assistant Examiner*—Tung S. Lau

(57) ABSTRACT

A refrigeration monitor and methodology are capable of detecting and recording data from selected sensors associated with monitored refrigeration equipment. The data are sampled periodically and stored as time series. Reference data are established and stored for normal operation of the system. Software operating on the data acts in real-time to detect fault conditions by comparing recent historic data with reference data. Upon detection of a fault, a technician is notified by a pager. Software used by the technician supports the monitoring in real-time of the operation of the refrigeration equipment and a review of the equipment's historical performance. The technician can access the monitor either by making a connection on-site or remotely over a communications network such as the Internet.

14 Claims, 15 Drawing Sheets

Select an Available Sensor Group

Select an available Sensor Group from the left hand box below. Click on the desired Sensor Group to give it a description, and to add it to the right hand box.

Sensor Groups In Use

SG1 Main Freezer
SG2 Walk In Fridge
SG3 Cooler #1
SG4 Big fREE
SG5 Test unit

< Back | Next > | Cancel

Fig. 14

Set Defaults for this Sensor Group

Sensor Group: 2 Walk In Fridge | Generate Defaults

Default Settings | Sub Systems

| | | | | | |
|---|---|---|---|---|---|
| High Voltage: | 210 | v. | Normal High Pressure Maximum: | 183 | psi. |
| Low Voltage: | 195 | v. | Normal High Pressure Minimum: | 138 | psi. |
| Peak Amperage: | 15 | A. | High Pressure Upper Limit: | 220 | psi. |
| Run Amperage: | 2 | A. | Normal Low Pressure Maximum: | 183 | psi. |
| On Cycle: | 2411 | secs. | Normal Low Pressure Minimum: | 138 | psi. |
| Off Cycle: | 1363 | secs. | Low Pressure Upper Limit: | 79 | psi. |
| | | | Low Pressure Lower Limit: | 30 | psi. |

< Back | Next > | Cancel

Fig. 15

REFRIGERATION MONITOR

FIELD OF INVENTION

This invention relates generally to the monitoring and diagnosis of faults occurring in commercial refrigeration equipment.

BACKGROUND OF INVENTION

Refrigeration equipment is used widely to preserve the quality and to extend the shelf-life of many commercially valuable products—principally food but also such items such as blood, plasma and other tissue. It is rare today to find a produce store of any size that does not have some refrigeration equipment. Generally, the sale of meat and dairy products without adequate refrigeration is prohibited by regulation. Refrigeration equipment may be located close to the origin of the foodstuff (be it a dairy, a slaughterhouse, packing or manufacturing plant) for temporary storage, during its transportation (on trucks, trains or ships), in warehouses or depots where it is again temporarily stored, and in retail outlets and restaurants where it is sold.

The most widely-used refrigeration systems rely on the cooling provided by an evaporator located within the space to be cooled or in thermal communication with the space to be cooled. This cooling is obtained by the rapid expansion of gas. A refrigerant gas is contained in a sealed conduit forming a closed loop. A compressor compresses the refrigerant in its gaseous phase into a condenser. The compression causes a heating of the refrigerant, and that heat is drawn away by a stream of air or water flowing over a heat exchanger associated with the condenser. Usually this loss of heat causes the refrigerant to liquefy. Liquid refrigerant is released through an expansion valve downstream of the condenser into an evaporator, in which the pressure is appreciably lower than that of the region upstream of the expansion valve. In the evaporator, vaporization of the liquid and expansion of the gas so produced occur. This expansion and vaporization require energy, which is taken as heat from the walls and surroundings of the evaporator, causing a cooling in the vicinity of the evaporator (including cooling of any chamber or the like with which the evaporator is in thermal communication). To facilitate heat exchange, the evaporator is typically provided with a heat exchanger and cooling fins, and a fan or the like is typically used to maintain a stream of air over the evaporator. The evaporator accepts heat from the air stream, reducing its temperature. The cool air so produced is circulated by the fan within the chamber to be cooled.

Many of the earliest refrigerators used ammonia as the refrigerant. This choice was thermally effective, but highly toxic. More recently some members of the class of chlorinated flourocarbons ("CFCs"), such as dichloroflouromethane $CCl_2F_2$, have been used as they are odourless and non-toxic in moderate quantities. However, CFCs have been found to be deleterious to the environment, with particularly troubling effects on the ozone layer of the atmosphere. More recently CFCs have been replaced with hydrocarbons such as cyclopentane.

The evaporator may cool sufficiently to form ice on its surface and, over time, ice build-up can become a problem. The ice acts as an insulator, with the consequence that the evaporator's heat exchanger may become blocked so that air cannot flow effectively over its surface. Periodically it is necessary to defrost the evaporator to remove the coating of ice. This is usually done using a defroster in the vicinity of the evaporator that employs a heater, hot gas or hot water to remove the ice build-up.

Typically, refrigeration systems are controlled either by one or more thermostats located in the space to be cooled or by a sensor measuring the refrigerant pressure in the evaporator. When one or more of these sensors indicates that the temperature or evaporator pressure has risen sufficiently to exceed an appropriate selected upper threshold, the compressor is activated, and cooling begins. Cooling continues until either a selected lower temperature limit is reached or the pressure in the evaporator has fallen sufficiently, at which time the compressor is turned off. Ideally, the compressor's ON and OFF cycles are regular and predictable (except of course when the refrigerator is opened to permit insertion or removal of its contents).

The impaired performance of a refrigeration unit is costly. Food that is not kept within an optimal temperature range loses its quality and can spoil; if it can still be sold, it typically commands a lower price. Taking a refrigeration unit off-line to be repaired means that there is less space available for the storage or display of produce. With a smaller variety of produce on display, sales are likely to be reduced. Typically, the value of the produce in even a modest cooler of a small grocery store is measured in the thousands of dollars; the value of cooled produce in a larger supermarket can be in the hundreds of thousands of dollars.

Refrigeration systems use energy to provide cooling. If they are working inefficiently, there is an additional cost for the energy consumed.

Problems with refrigeration equipment that lead to faults or failure include the following:

- Leaks of the refrigerant. The piping and seals that contain the refrigerant are subject to vibration stresses that eventually can cause cracking or rupture of the metal. Corrosion from oxidation or the effects of acid impurities can also cause leaks.
- Heat exchangers used in the condenser and in the evaporator are designed to present a large surface area and to be made of thin metal for better heat conduction. This makes them fragile and prone to breaks if they are mishandled.
- A compressor typically has a pump driven by an electric motor. Both the pump and the motor have mechanical parts including valves, bearings, seals and brushes, all of which wear with use over time, leading to possible breakdown.
- Fans are frequently used to maintain streams of air over the condenser (to remove heat) or over the evaporator (to distribute cold air). The fans have mechanical and electrical parts that can wear and ultimately fail.
- The heat exchangers can become coated with dust, dirt or ice or their heat-exchange surfaces blocked with items such as plastic bags or paper.
- The power supply may be subject to voltage spikes, may suffer periods of low voltage, be interrupted or overloaded.
- The defroster may lose power or, if the defroster is of the hot-gas type, the solenoid may seize, and the defroster will be unable to remove ice build-up from the evaporator.

The early detection of fault conditions can mean the avoidance of more costly repairs. Quite commonly, electromechanical devices such as pumps and fans show signs of poor performance well in advance of failure. Being able to spot and correct a deteriorating situation before it becomes critical can save considerable down time and expense.

For example, a slow leak of refrigerant will probably produce a predictable pattern of system operation. At first, with less refrigerant to work with, the compressor will have to run for a longer on-cycle to achieve an equivalent cooling effect. If the compressor is regulated by a thermostat within the refrigerated compartment, the length of the on-cycles will continue to increase until a point is reached where the compressor does not shut off at all. Alternatively, if the compressor is regulated by the pressure at its intake, the drop in pressure from the loss of refrigerant will cause the compressor to be shut off early, typically just after it has started up. This is often referred to as "short-cycling". In some cases, the protective circuitry of the compressor will ensure that the compressor is shut down, sometimes without any warning. This may protect the compressor from damage but may jeopardize the food stored in the refrigerated compartment. Another problem may be that the compressor refuses to start. Diagnosing why this is so is greatly simplified if the service technician has access to the recent history of the compressor's operation. Further, if the length of the on-cycle can be routinely monitored, the problem may be detected before it has become critical.

As a further example, an electromechanical device like a compressor has bearings, bushings and its drive motor has brushes. These are all parts subject to wear. Over a period of time there will be increased resistance caused by friction, particularly if lubrication has been inadequate for any appreciable time. This resistance can be readily observed as a persistently increasing current drawn by the compressor during operation and by a longer period of high current draw during start-up. Knowing well in advance that the compressor is beginning to have trouble is of great value as it enables operators of the equipment to plan for a compressor replacement at a convenient time and avoid a complete breakdown.

There is a considerable variation in the operating environment of refrigeration equipment; it is difficult to predict what are normal ranges for various operating parameters of the equipment. Variations in performance are to be expected—for example, ambient temperature, number of people in the vicinity, the mass of stored material in the refrigerator or freezer, etc. will vary appreciably from day to day and sometimes from hour to hour. There may be variations in the power supply voltage. The quality of wiring and connections will vary from installation to installation. And there is typically significant variation in the number of times in a day the cooling/storage compartment is opened, and for how long. The situation is further complicated as some enterprises will have a number of coolers, chillers and freezers operating.

The diagnosis of problem situations is normally a matter that needs attention from a qualified technician and is not usually addressed by staff untrained in refrigeration. To avoid the risk of lengthy down time, such technical help may be required 24 hours per day and is sometimes not to be found close at hand. This can cause the following types of difficulties:

The technician may be called in when he is not needed. For example, a warning that the compressor has been running for longer than usual may simply be due to the fact that the freezer door has been left open.

The technician may not be advised correctly or be advised too late of the problem situation. In either situation, the technician may not be able to respond in time to prevent a critical situation.

The technician may not have available sufficient information to make an accurate diagnosis of the problem. If he is lucky, upon arrival, the technician may find that the refrigeration unit still functions and that some sensor information is available. But the system may by the time the technician arrives have reached a critical situation and may have had to be shut down, either manually or by protective circuitry. When this is the case, the technician may have limited information available from which to diagnose the problem. In some circumstances attempts at diagnosis can lead to further damage. With inadequate information, repairs are often more costly as components that are working properly are sometimes needlessly replaced in an attempt to fix the problem.

Many types of refrigeration monitoring equipment have been devised previously. However, such equipment has typically dealt with some but not all important aspects of the problems facing service technicians. In particular:

(1) Designs of prior monitoring equipment typically do not permit a comparison of pre-failure equipment performance with the problem performance leading up to the failure. Prior designs typically do not allow for the recording of operational parameters as historical time series for monitoring purposes. A "time series", as used herein, means a series of values of a parameter obtained and recorded at successive times, usually with equal intervals between the times.

U.S. Pat. No. 5,209,076 (Kauffman et al., 1993) teaches the measurement of a selection of operational parameters and comments on the value of their collection over an extended period of time. U.S. Pat. No. 4,090,371 (Keane, 1978) teaches apparatus for monitoring the characteristics of lubricating oil at significant points within the compressor and points out that recording the precursor history prior to malfunction can provide diagnostic information for speedy repair. However, in neither of these patents is there any teaching in any enabling disclosure of the details of how the collection and recording of useful historic data might be accomplished.

(2) Prior teachings typically fail to take into account the idiosyncratic nature of the components installed in any particular refrigeration unit. For example, consider the problem faced by an engineer or technician to determine a reasonable value for the average duration of the compressor on-cycle. There are many manufacturers of compressors, each of whom typically sells many models of compressor. Further, the performance of any particular compressor, even of the same make and model, varies. Once a compressor has been selected, the duration of the on-cycle will depend on many other factors—such as the other components installed, the size of the refrigeration compartment, the amount of insulation installed, ambient temperature, and how much unrefrigerated material is within the refrigeration unit. Typically, this has meant that reference values for operational parameters have been selected with a good measure of guesswork, or by way of averaging over a large number of units, and that historical parameter values recorded as a time series have not been used.

(3) The prior art typically does not disclose adequate means for providing supporting data to a service technician to improve his ability to diagnose a problem. In some cases, refrigeration monitoring equipment does nothing more than shut down equipment that may be suffering from some problem within a selected set of problems. In a few cases, the service technician can find out which operational parameter has a value indicating a fault. Prior monitoring apparatus typically does not include means for notifying the technician of possible alternative causes for the reported problem.

(4) Frequently, refrigeration monitoring equipment includes checks on the values of operational parameters such as refrigerant pressure, the temperature in the refrigerated compartment and the currents drawn by and voltages applied to electrical equipment. However, few designs of prior monitoring equipment take into account all of the principal problem types with which a technician must cope. For example, prior monitoring devices typically do not include means for comparing the duration of the compressor's on- and off-cycles against normal values.

In the prior art, a number of issued patents address the problem of detecting leaking refrigerant. A common solution to this problem is to detect the presence of the refrigerant, or a tracer chemical mixed with the refrigerant, as it leaks into the air surrounding the refrigeration unit. An example of this approach is set out in U.S. Pat. No. 6,131,636 (Singh et al., 2000) in which the inventors teach the use of dye that fluoresces under ultraviolet light.

Alternatively, low refrigerant charge can be detected by observing the pressure either at the suction side of the compressor (as in U.S. Pat. No. 5,481,884 Scoccia, 1996) or at the discharge side of the compressor (as in U.S. Pat. No. 5,586,445 Bessler). However, the pressure of the refrigerant needs to be measured after the system has had a chance to stabilize, and this is difficult to determine without an effective record of the operating parameters each as a time series. For example, U.S. Pat. No. 5,044,168 (Wycoff 1991), discloses a method for detecting low refrigerant levels by comparing the suction pressure and the discharge pressure while the compressor is idle during a defrost cycle.

U.S. Pat. No. 5,934,087 (Watanabe et al., 1999) teaches the use of two temperature sensors and a means for measuring the cumulative running time of the compressor to judge a refrigerant leak. This approach suffers from the drawback that the monitor will report a refrigeration leak only once the loss of refrigerant is almost complete and the compressor is running for an extended on-cycle. This approach may provide a correct diagnosis of the problem; however, diagnosis may come too late, in that by the time such a report is received, the temperature in the refrigerated compartment may have risen and jeopardized the quality of its contents. Although Watanabe recognizes the importance of the duration of the on-cycle, the apparatus disclosed does not record the compressor's current drawn as a time series, and comparisons of on-cycles over a period of time are not possible. Further there is no indication how reference values are to be determined.

U.S. Pat. No. 6,354,093 B2 (Davis et al., 2002) teaches the measurement of the most recent compressor running time, the evaporator coil temperature, last door-alarm time, last defrost time period, door-closed time period, and discharge-line temperature, to determine when a defrost operation is required and to monitor for condenser clogging and refrigerant leaks. The efficacy of the algorithms presented in Davis rely on having threshold values available for all of the operational parameters, but Davis provides no enabling disclosure on how these values are to be chosen. Further, the algorithms presented do not take into account all the fault events that could occur. For example, the claimed control system fails to detect the following fault situation:

the defrost operation is not overdue (that is LDTP<TLDTP);

the compressor running time (CRT) exceeds the desired threshold value (TRT);

the discharge line temperature (DLT) is within reasonable bounds;

the reason for the long CRT value is due, not to the loss of refrigerant or the clogging of the condenser, but rather to the malfunctioning of the compressor.

U.S. Pat. No. 4,553,400 and 4,612,775 (Branz, 1985 and 1986) disclose a selection of sensors combined with a digital display to monitor a section of operating parameters, including a direct measurement of the refrigerant level.

A number of patents deal with the detection of problems with the compressor. In U.S. Pat. No. 4,090,371 (Keane, 1978) the inventor teaches apparatus for monitoring the nature of the lubricating oil at significant points within the compressor. Keane makes the point that recording the performance history prior to malfunction can provide diagnostic information for speedy repair, but provides no disclosure of how this might be done.

Other prior patents focus on different items of equipment or specific narrow methodology for dealing with a small number of faults but not all of the more common ones. For example, U.S. Pat. No. 5,009,075 (Okoren, 1991) describes a fault determination method for refrigeration units that incorporate an electronic expansion valve and electronic controller. In U.S. Pat. No. 6,205,798 B1 (Porter et al., 2001) the inventor teaches a method for the automated detection of leaks through the compressor. U.S. Pat. No. 4,848,096 (Funahashi et al., 1989) discloses means to make an automatic diagnosis of the pressure sensors as measured on the input and output sides of the compressor without disassembly of the compressor.

In U.S. Pat. No. 6,332,327 B1 (Street et al., 2001), the inventors disclose apparatus and methods particularly suited to control refrigeration equipment in large supermarkets. Typically such equipment makes use of multiple compressors, each of which has a number of sensors. The inventors disclose a safety and control module incorporating a bus for communication between modules to simplify the wiring for communication between the system's active components. This makes it possible to distribute the intelligence required to operate multiplexed compressors.

(5) The prior art includes reference to the use of telecommunication equipment to notify a service technician of a problem. For example, Kauffmann (supra) teaches the desirability of automatic notification of a service technician over a telephone line. However, Kaufmann fails to provide any disclosure detailing how this might be carried out.

U.S. Pat. No. 5,136,281 (Bonaquist, 1992) discloses a "Monitor for remote alarm transmission".

U.S. Pat. No. 4,482,785 (Finnegan et al.) discloses means to alert technicians by telephone of any unusual temperature detected within a freezer compartment.

(6) The prior art typically discloses no means for a service technician to connect a monitor electronically to refrigeration equipment from a remote location and to access historical and real-time data representing the values of significant operational parameters.

SUMMARY OF THE INVENTION

In this specification, it will usually be presupposed that the equipment to be monitored is refrigeration equipment whose cooling compartment or chamber stays above freezing temperature. However, in many respects, the operation in principle of a freezer is identical or analogous to that of a refrigerator. And the operation of heat pumps and air conditioners is also essentially analogous to the operation of refrigerators. With appropriate selections and modifications, it will be apparent to those skilled in such technology how to adapt to the monitoring of such analogous equipment the teachings of this specification relating to refrigeration equipment.

(1) In one aspect of the invention, a novel process is disclosed to obtain the values of selected parameters from associated sensors located on one or more refrigeration units, convert those values to digital form in standard units, and at regular intervals to record the digital data in a database. Apparatus is disclosed that implements the method.

In this aspect of the invention, the database contains a historical record of the values of selected important refrigeration parameters during the recent operation of the refrigeration unit. This record is of particular value to service technicians, as it makes possible the detection of faults that previously went undetected. For example, the duration of the on-cycle of the compressor is a critical measure of the refrigeration unit's performance. In many situations the detection of the deterioration of the refrigeration unit's performance can be inferred from the detection of a steadily increasing compressor on-cycle. Such fault detection provides an early warning in advance of catastrophic failure. Note that the off-cycle duration can also be important; compressor valve problems are sometimes revealed by analysis of both the on-cycle and off-cycle.

(2) In a further aspect of the invention, a specific combination of computer hardware and software elements is disclosed that provides an embodiment of the functionality of the process described in aspect (1) above. The preferred combination is premised upon the use of suitable sensors (that are frequently analog sensors) for monitoring selected parameters of given refrigeration equipment. Such combination preferably comprises data collection, processing and operations equipment, and associated peripherals such as display monitors and analog-to-digital converters. One or more signal reception units each comprising a microcontroller with associated memory and communication components operates under the control of a computer program. The sensors may each be connected to an associated signal reception unit. Alternatively, a single signal reception unit could receive input from all of the sensors and provide data output in a form that preserves the association of value data with the sensor source of such data. A computer suitably programmed, which may incorporate the microcontrollers or the microcontroller functionality just mentioned, causes the reading of the values of signals generated by the sensors, conversion of the values of any analog signals to digital values, and supply of the resulting digital values to an alarm, monitoring and reporting unit (MRU) via a communications interface. The MRU may comprise a general-purpose microprocessor having associated memory, permanent storage and communication components, operating under the control of a computer program. In addition to or as part of the MRU, a receiver may be provided for receiving selected data and performing one or more operations thereon. The receiver may provide a suitably interfaced display of data, may provide an alarm, may provide printed data reports, and/or may provide an interactive interface to enable a monitoring technician (say) to interrogate the MRU. The receiver preferably has means for providing an alarm (in the event of an existing or incipient fault condition), a display for selected sensed parameter values (current or historic or reference or combinations thereof) and/or existing or incipient fault conditions, and reports on selected sensed parameter values (again including current or historic or reference or combinations thereof) and/or existing or incipient fault conditions.

The computer program operates on a stream of digital sensor data received from each or the signal reception unit via one or more communications ports. The data received include time-related values obtained periodically from each sensor. The computer program causes such data to be stored in a historical time-series database preferably located in permanent storage. Such data are useful to technicians and equipment manufacturers as they provide a historical record of the performance of the equipment.

In the preferred embodiment, the program executes a set of performance checks on the digital sensor data to detect faults. If a fault is detected, the program causes a suitable message to be prepared comprising at least the location of the equipment, the nature of the fault and the date and time the fault was detected. The message is sent by conventional telecommunication means to a receiving station, which may, for example, be the pager of a service technician.

(3) In a further aspect of the invention, a novel process and suitable novel apparatus for practising the process are provided for detecting faults in a refrigeration system. It has apparently gone unrecognized by anyone developing prior monitoring apparatus and methodology for use with refrigeration equipment that if one wishes to be comprehensive about fault diagnosis, one must make a carefully considered selection of the system parameters. According to the invention, a preferred selection of refrigeration system parameters is made, sensors are provided to sense the values of these selected parameters, and their values are repeatedly collected at predetermined time intervals from the sensors, which are located on or in association with components of the refrigeration equipment or apparatus peripheral thereto such as the power supply. In a subsequent step, the values of the parameters detected in each parameter value sensing cycle and relevant values stored for earlier cycles are used as inputs to a novel set of performance checks The preferred selected refrigeration system parameters for an electrically powered refrigerator with a defroster are:

(a) the alternating current line voltage V (assuming an AC rather than a DC electric power supply;);
(b) the compressor current A;
(c) the defroster current D;
(d) the refrigeration chamber temperature T;
(e) the evaporator pressure LP; and
(f) the condenser pressure HP.

If there is no defroster, the defroster current would of course not be monitored. If the defroster is present in the equipment but not a self-contained electrically powered device—perhaps instead a hot gas defroster, usually some other parameter can be substituted for the defroster current. For example, if a solenoid opens and closes a conduit valve for the hot gas, the solenoid current could be monitored.

In some cases, one would measure DC current instead of AC, depending upon the electric power source used to power the equipment or selected components of the system.

If the equipment is not electrically powered, again it will often be possible to monitor some substitute set of parameters for the electric current and voltage parameters mentioned above. For example, if the compressor is driven hydraulically, or is gas or diesel powered, usually some substitute measurement can be made, such as fuel consumption, hydraulic fluid flow, hydraulic pressure at specified locations—e.g. upstream and downstream of the compressor, or the like.

Finally, although the parameters listed above are considered to be suitable for small-to-medium size electrically powered equipment monitoring, substitute parameters might be measured for larger installations. For example, if a compressor is very large and draws a heavy electric current under load, an ammeter suitable to measure such large current may be expensive. In such case, it may be preferable to measure a substitute set of parameters, perhaps doing so even if the result is some loss of precision—an approximation of the value sought. One might, for example, measure line current rather than compressor current draw, and measure the voltage drop across the compressor. Or one might use a wattmeter to measure the power drawn across the compressor in a succession of time intervals. Other parameter substitutions suitable for use in particular installations will readily occur to those skilled in this technology.

What is paramount in the parameter selection aspect of the invention is the selection of a set of parameters that together will generate useful reference, historic and present data so that a technician, preferably assisted by suitable data analysis software, may diagnose and remedy the majority of common problems encountered in typical refrigeration installations.

The performance checks to be performed on the preferred embodiment of the refrigeration equipment, making use of the selected parameter measurements, at each iteration of such measurements, are presented in detail below. In summary, with reference to the preferred embodiment of the invention in which electrically powered equipment is being monitored, there are 18 preferred warnings/alerts from performance checks, as follows:

(a) Power-outage alert
(b) Power-restored warning
(c) High-voltage warning
(d) Low-voltage warning
(e) Locked-rotor amperage alert
(f) Long compressor on-cycle warning
(g) Long compressor on-cycle alert
(h) Short compressor on-cycle warning
(i) Short compressor on-cycle alert
(j) Long compressor off-cycle warning
(k) Long compressor off-cycle alert
(l) No-refrigerant-pressure alert (no refrigerant pressure on intake side of compressor)
(m) Cut-out-pressure-too-low warning (pressure on intake side of compressor too low while the compressor continues to pump)
(n) Cut-in-pressure-too-high warning (pressure on intake side of compressor too high while the compressor has not yet begun to pump)
(o) High-pressure warning (compressor is pumping and the pressure on the condenser side of the compressor is too high)
(p) High-pressure alert
(q) High-defroster-current warning
(r) Low-defroster-current warning The purpose and effect of the performance checks is to identify situations in which the values of the sensed parameters indicate that the performance of the refrigeration system has changed significantly and probably requires the attention of a service technician. The performance checks are selected to detect situations of two types. Certain performance checks identify less serious situations which are reported as "warnings" and typically identify either an incipient fault or an existing fault that will not jeopardize the immediate ability of the monitored equipment to refrigerate, albeit perhaps inefficiently. Other situations are considered to be critical or more serious and are reported as "alerts".

(4) In a further aspect of the invention, a specific combination of computer hardware and software is disclosed that provides an embodiment of the functionality of the process described in (3) above. The computer hardware is as described in (2) above. The computer program installed to operate the hardware, however, in the preferred embodiment executes instructions to conduct the performance checks summarized above and that are described further in the detailed description of the preferred embodiment below.

(5) In a further aspect of the invention, a novel process ("learning mode") is provided for the calculation of preferred reference values of configuration parameters to be stored for subsequent use with performance checks of the type referred to in (3) and (4) above. Such reference values of the selected configuration parameters represent set values or limits on ranges of values at or within which the operation of a refrigeration unit, as measured by sensed continuing values of refrigeration system parameters, is considered to be satisfactory.

In a first step, reference values of the selected configuration parameters are determined or calculated from historical records retained in permanent storage or from reference values believed to be reliable, such as manufacturers' recommended values for equipment components. Optionally and preferably, these reference values may be updated and revised by a skilled technician familiar with the equipment and with other sources of information such as safety regulations and understanding of the preferred operation of similar configurations of components. The measured, calculated or determined configuration parameter values, revised by a technician as required or preferred, are then stored in permanent memory storage.

The technique for determining the reference values of configuration parameters is general and can be applied to a variety of parameters, stored in a number of different ways for use with many different sets of performance checks. However, in the preferred embodiment described herein, the historical records are created and stored in a database by the process described in (1) above and/or by the apparatus described in (2) above, and the reference values of configuration parameters so determined are subsequently used with performance checks of the type referred to in (3) and (4) above.

The advantages of the learning-mode technique are:

(a) The reference values measured, calculated or determined represent the actual operation of a configuration of a number of components. Although fairly good estimates or ranges for the configuration parameters can be supplied by manufacturers or technicians, these do not take into account the particular nature of the installation, the patterns of usage, ambient climate conditions or seasonal climate fluctuations. So typically the manufacturers' recommended reference values for a given component of the refrigeration equipment may not precisely coincide with preferred configuration values for an actual configuration of installed equipment including such component.

(b) Learning-mode measurements may be repeated should the components of the refrigeration unit, the sensors, or the performance-checking software change.

(6) In a further aspect of the invention, a specific combination of computer hardware and software is disclosed that provides an embodiment of the functionality of the process described in (5) above. The computer hardware is a general purpose personal computer readily available commercially, having a microprocessor, memory, permanent storage and telecommunications components. The computer operates under the control of a computer program which executes instructions to effect the process disclosed in (5) above.

(7) In a further aspect of the invention, a process is disclosed whereby values of refrigeration parameters, stored as time series data in a historical database, are retrieved for subsequent review for the diagnosis of refrigeration equipment faults.

The preferred process as performed by the preferred apparatus is as follows:

(a) The interrogating computer requests from the signal reception unit or set of signal reception units data representing the values of sensed operating parameters from a historical time series database that may be located in the vicinity of monitored refrigeration equipment or may be remotely located (data storage may be arranged in network memory, in an internet database, or as may be found suitable by the user).

(b) The computer arranges the transfer of the requested data to selected permanent storage, and if so required, makes use of conventional telecommunications equipment and protocols to transfer data;

(c) For the convenience of an attending technician, the computer arranges the repeated display of successive sets of the values of each of the sensed refrigeration parameters (or, if desired, selected ones of them) on a display screen, each set of values corresponding to one point in time, and the interval between successive displays of data values preferably being controllably adjustable to speed up or speed down the display of the data.

(d) The computer software operates to execute performance checks at each iteration of the parameter values. Analysis of the results of the performance checks leads to the detection of existing or incipient fault conditions in the refrigeration equipment. In at least some cases, the performance checks will involve a comparison of present or immediately preceding historic data with reference values obtained in learning mode.

(e) If a fault condition is detected, the computer software operates to cause a report, alert or warning to be transmitted to a recipient such as an observing service technician. The transmission identifies the whereabouts and nature of any fault conditions detected.

The foregoing process has several advantages, most notably that a service technician can observe the recent operation of the refrigeration equipment without having to visit the site. Further, the technician is able to review the recent history of the equipment's performance, possibly speeded up, to assist in diagnosing problems.

Of value is the ability of the apparatus performing the foregoing process to display the refrigeration chamber temperature at suitable selected times, and to provide and/or preserve the data in a form suitable for presentation to a health inspector (8) In a further aspect of the invention, a specific combination of computer hardware and software is provided that provides an embodiment of the functionality of the process described in (7) above. The computer hardware is a general-purpose computer, preferably for the sake of economy a personal computer readily available commercially, having a microprocessor, memory, permanent storage and telecommunications components. The computer operates under the control of a computer program that executes instructions to effect the process disclosed in (7) above.

The diagnosis of an existing or incipient fault condition is preferably performed automatically or semi-automatically with some interaction between the monitoring apparatus and the user of that apparatus. To that end, suitable algorithms may be devised that, when implemented by the monitoring computer, analyze alert or warning conditions and/or related parameter or reference data relating to such conditions, and provide at least a first-attempt diagnosis of the equipment problem that apparently has prompted such alert or warning. However, there is extensive variation from one refrigeration equipment installation to another, and the monitored parameters may not be identical for each item of monitored equipment. Furthermore, reference data for any two installations may vary considerably. So to a large extent, the choice of algorithms to be used is within the designer's preference. The present invention is not directed to any such choice as such, nor even broadly to automatic diagnosis. Rather, the present invention provides apparatus and a methodology that is capable of providing a foundation for such diagnostic analysis as the designer may wish to employ for any particular refrigeration equipment installation.

Other features and advantages of the invention will become apparent from the detailed description and the claims that follow. Note that the system designer may select for inclusion in the retrievable data for examination by a technician or data processing by the system, whatever information or parameter values the designer considers suitable. For example, records of all those contractors who have been responsible for the installation of the monitors and sensors for a selected unit of refrigeration equipment could be stored. Or records of service previously performed on a selected unit of refrigeration equipment could be stored. The invented system is not constrained by the particular selection of data or of monitored parameters included by way of exemplification in the detailed description that follows.

BRIEF DESCRIPTION OF THE DRAWINGS

FIGS. 12 to 19 inclusive are screen prints or partial screen prints from a monitor used to monitor an exemplary refrigeration system, using the methodology and apparatus of the present invention.

FIG. 12 depicts an initially viewed dialog box presenting options for adding or removing and/or configuring refrigeration equipment or for retrieving or uploading data.

FIG. 13 depicts a dialog box premised on the selection by the user of the second of the five options displayed in the dialog box of FIG. 12, presenting a further three options to the user.

FIG. 14 illustrates a monitor screen print of a dialog box presenting a representative five choices of refrigeration equipment to be selected by the user.

FIGS. 15 and 16 illustrate dialog boxes permitting the user to select default or reference settings for the monitored equipment. The FIG. 15 options are directed to parameter value settings whereas FIG. 16 permits selection of default options for the various types of equipment and equipment components displayed.

FIG. 17 illustrates a dialog box for displaying selected present or historic parameter data.

FIG. 18 is a screen print displaying selected parameter graphs associated with a selected message field in the Alerts window of the dialog box of FIG. 17.

FIG. 19 is a screen print displaying historic data graphs for selected parameters.

DETAILED DESCRIPTION

The preferred embodiment of the invention is described with reference to FIGS. 1 to 10.

Figure 1:
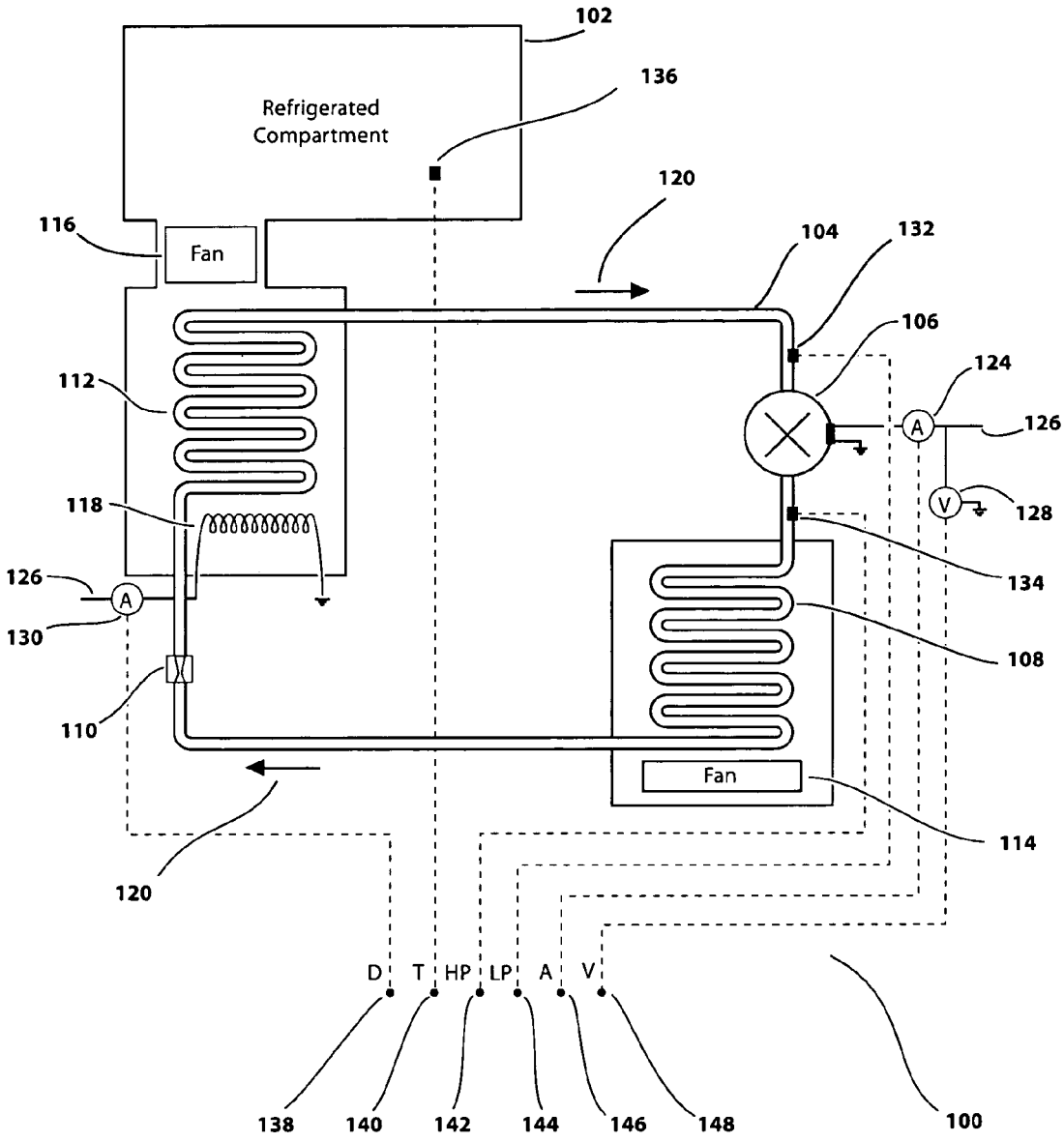
FIG. 1 is a schematic diagram of a refrigeration unit with sensors installed to measure selected operational parameters, in accordance with an embodiment of the invention.

FIG. 1 shows a schematic drawing of the principal components of a representative refrigeration unit, shown generally as 100, for cooling a refrigerated compartment 102. The refrigeration unit 100 is constructed conventionally of conventional components. The temperature T in the refrigerated compartment 102 is measured by a thermometer 136 whose output is provided at terminal 140.

A suitable refrigerant is contained within piping 104 forming a closed loop. A compressor 106 is powered by electric current obtained from an AC line 126. The voltage V and current A supplied to the compressor 106 are measured by a voltmeter 128 and an ammeter 124 respectively. The voltmeter 128 provides a signal representative of voltage V at terminal 148 and the ammeter 124 provides a signal representative of current A at terminal 146.

When in operation, the compressor 106 pumps the refrigerant through the piping 104 in the direction of the arrows 120. In certain situations, such as when the refrigerant must be pumped against gravity for a considerable height, an auxiliary pump or pumps (which are not shown) may be employed to assist in moving the refrigerant.

The refrigerant is pumped from the compressor 106 via the pipe 104 to and through an expansion valve 110. The expansion valve 110 restricts the flow of refrigerant and creates a back pressure so that the refrigerant is compressed, particularly in the vicinity of the condenser 108. The compression of the refrigerant causes an increase in its temperature. The temperature is reduced by forcing air from a fan 114 over a heat exchanger (not shown in FIG. 1) in close thermal contact with the condenser 108. The pressure HP of the refrigerant within the condenser part of the loop is measured by a sensor 134 that provides an output pressure data signal at terminal 142.

The refrigerant is forced by the compressor 106 through the expansion valve 110 into an evaporator 112. The pressure LP of the refrigerant within the evaporator part of the loop is measured by a sensor 132 whose output signal is available at terminal 144. The pressure difference between pressures LP and HP is maintained by the combined action of the compressor 106 and the expansion valve 110. The expansion of the refrigerant downstream of the expansion valve 110 causes it to cool. In a common configuration, the cool refrigerant within the evaporator 112 draws heat from air circulated by a fan 116 over a heat exchanger (not shown in FIG. 1) that is in close thermal contact with the evaporator 112. The resulting cooled air flows to the interior of the refrigerated compartment 102, absorbing heat from its walls and contents. The air completes a closed circuit through a duct returning to the vicinity of the evaporator 112 (the two air conduits illustrated on either side of the fan 116 may be thought of as representing exit and inlet conduits from the evaporator compartment to and from the refrigerated compartment 102). Alternatively, the evaporator 102 itself can be placed within the refrigerated compartment 102.

Whenever there is a difference in pressure across the expansion valve 110, refrigerant flows through the expansion valve 110 to the evaporator, causing (as already mentioned) a cooling effect in the evaporator 112. Periodically, as determined by control circuitry, the compressor 106 runs to maintain or increase the pressure difference between pressure in the vicinity of the condenser (HP) and the pressure in the vicinity of the evaporator (LP). Such control circuitry is entirely conventional and typically uses the temperature within the refrigerated compartment 102 and the pressure in the evaporator 112 to determine when the compressor 106 should be powered on. The associated control circuitry and compressor switch are not illustrated in FIG. 1.

At selected times or under selected conditions, the compressor 106 is halted so that evaporator 112 may be defrosted. For this purpose, commonly, a defroster coil 118 is energized to heat the evaporator 112 and remove any build-up of ice. The defroster 118 is powered by electricity from an AC line 126; the current D drawn for this purpose is measured by an ammeter 130 whose output is provided at terminal 138. In an alternative configuration (not shown) solenoid valves are used to direct the hot compressed gas from the compressor directly to the evaporator, by-passing the condenser 108 and the expansion valve 112. This hot gas defroster is particularly effective as the hot gas passes directly through the heat exchanger of the evaporator 112, and removal of ice can be relatively rapid.

Figure 2:
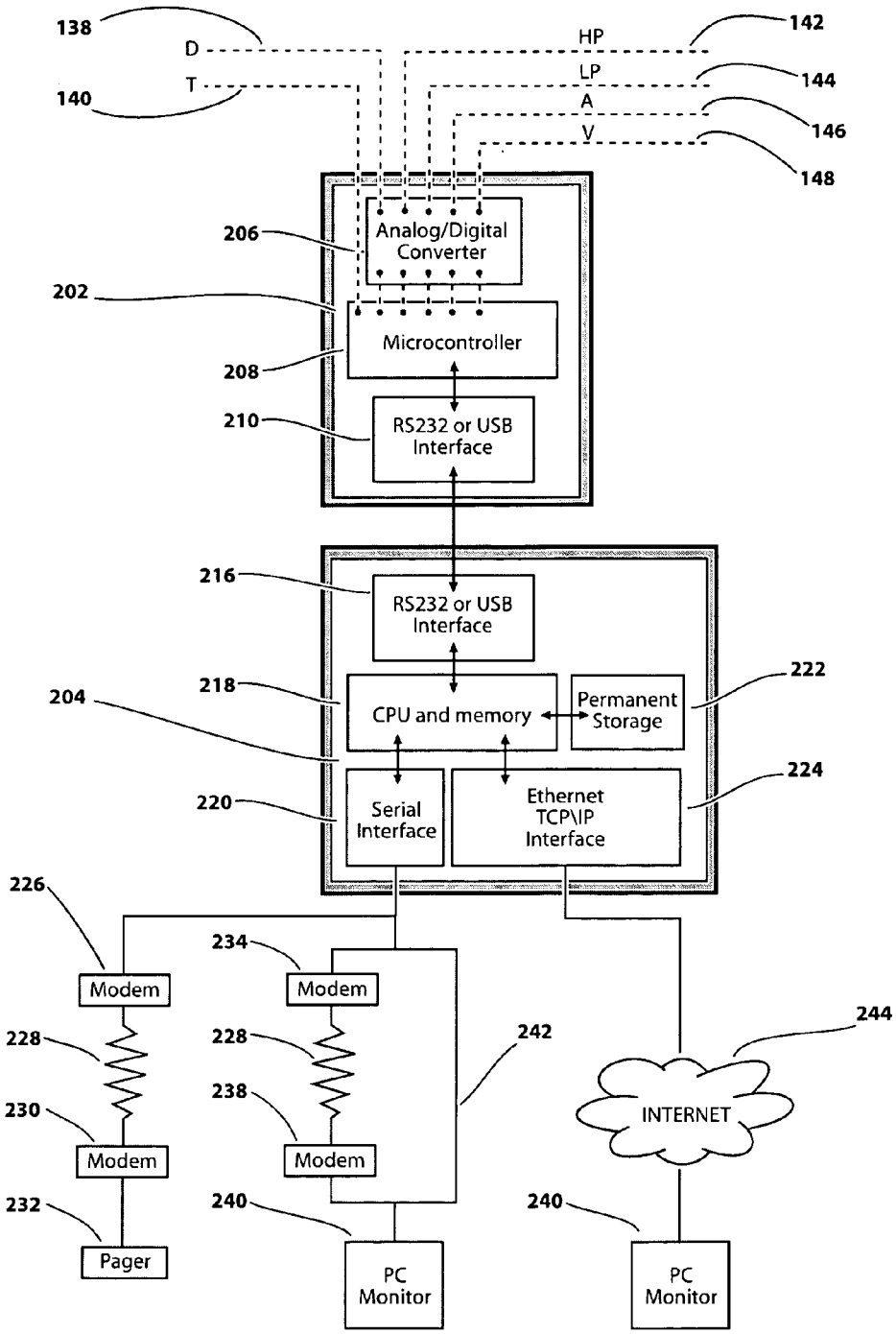
FIG. 2 is a schematic drawing of the principal hardware components of a preferred embodiment of a refrigeration monitor and associated signalling devices according to the invention, detailing the reception of signals from the sensors, the conversion of the signals to digital form, their recording and analysis, and the distribution of warnings and related information by various communication means to technicians or observers.

Conveniently, all output terminals 138 through 148 are located in proximity to one another for connection to suitable selected monitoring, control or recording devices (not shown in FIG. 1). For many monitoring, recording and control purposes, the sensed values are most conveniently provided as digital values. If the sensors 124, 128, 130, 132, 134 and 136 do not directly provide a digital output, analog/digital converters (not shown in FIG. 1) may be interposed between the sensors 124 to 136 and the terminals 138 to 148, or may be interposed between the terminals 138 to 148 and the associated monitoring, recording and control devices (as is shown in FIG. 2).

The sensors used may be conventional and are readily available commercially. Examples of suitable sensors are as follows:

| Manufacturer | Part Number | Sensor Range | Parameter sensed |
|---|---|---|---|
| Texas Instruments | 2CP5B0520150ANY | 0–150 psi | Low pressure, LP |
| Texas Instruments | 2CP5B0520150SNY | 0–500 psi | High pressure, HP |
| AAC | 108-270C | 0–270 volts | Line voltage, V |
| AAC | 1005-200 | 0–200 A | Compressor current, A |
| AAC | 1005-200 | 0–200 A | Defrost current, D |
| Dallas Semiconductor | DS18S20 | −10° C. to 85° C. | Temperature, T |

Of the sensors selected in the table above, the two pressure sensors 134 and 132, the voltage sensor 126 and the two ammeters 124 and 130 are analog devices producing output signals in the range 0–5 volts. The Dallas Semiconductor thermometer 136 is a digital device producing a signal with 9-bit resolution.

FIG. 2 shows a schematic drawing of the preferred embodiment of monitoring apparatus and associated devices arranged in accordance with the invention. Hardware for such apparatus is assembled as two parts: a signal reception unit ("SCU") 202 and an alarm, monitoring and reporting unit ("MRU") 204. Conveniently, at least the signal collection unit 202 is attached to or proximate to each refrigeration unit 100 (FIG. 1); the MRU 204, if desired, may be located in a clean area reasonably close to the refrigeration unit 100 or may be remotely located, or more than one such MRU may be provided. In this particular embodiment, a single signal reception unit 202 serves to collect data from all of the sensors 138 to 148.

Those signals from the sensors 138 to 148 that are not already in digital form (typically sensors 138 and 142 to 148 if the equipment selection conforms to the exemplary selection in the above table) are first converted to digital form by the analog-to-digital converter 206. A microcontroller 208 repeatedly reads the sensor signals, reformats them and makes them available as digital sensor data at the interface 210. The microcontroller 208 may be a standard commercially available processor such as a MicroChip PIC16C770 processor. The following description of the format of the digital sensor data and the protocol for its transfer from the SCU 202 to the MRU 204 is exemplary; the system designer may vary the details to meet the prevailing requirements for any given installation.

In the following description, hexadecimal values are shown prefixed by "0x". For example, the hexadecimal value for the integer 32 would be shown as 0x20.

In this example, the format for the digital sensor data, originating at the SCU 202 for transmission to the MRU 204, has 16 bits for each data value. There are 12 bits for the data value itself and 4 bits to record the reference number of the sensor from which the signal originated. Each digital sensor data value is laid preferably as follows:

Digital Sensor Data Value: Byte 1

| | | | | | | | |
|---|---|---|---|---|---|---|---|
| $B_4$ | $B_5$ | $B_6$ | $B_7$ | $B_8$ | $B_9$ | $B_{10}$ | $B_{11}$ |

Digital Sensor Data Value: Byte 2

| | | | | | | | |
|---|---|---|---|---|---|---|---|
| $C_0$ | $C_1$ | $C_2$ | $C_3$ | $B_0$ | $B_1$ | $B_2$ | $B_3$ |

The digital value of the data from a given sensor is stored as an integer with 12 bits of precision, in bits, $B_0$ to $B_{11}$. Each sensor is assigned a unique channel number that is stored in bits $C_0$ to $C_3$, thereby permitting the output signals from the various sensors to be distinguished from one another. There is also one reserved channel. Suitable channel numbers are:

| Channel | Signal |
|---|---|
| 0000 | Low pressure LP 144 |
| 0001 | High pressure HP 142 |
| 0010 | AC line voltage V 148 |
| 0011 | Compressor current A 146 |
| 0100 | Defrost current D 138 |
| 0101 | Reserved |
| 0110 | Temperature T 140 |

The microcontroller 208 is initially in an idle state. The microcontroller 208 is readied for operation upon receipt of a two-byte initiating sequence. The first byte of that sequence specifies which of seven sensor values are to be sent. The second byte contains a coded value for the sample rate.

Each of the seven low-order bits in the sensor selection byte indicates whether a particular sensor signal should be transmitted. The high-order bit is always set to 1 so that the sensor selection byte will not be confused with the sample rate byte.

| Sensor Selection Byte | | | | | | | | |
|---|---|---|---|---|---|---|---|---|
| Bit | 7 | 6 | 5 | 4 | 3 | 2 | 1 | 0 |
| Value | 1 | x | x | x | x | x | x | x |

The sample rate byte is, in this example, one of the following values:

| Sample Rate Byte | |
|---|---|
| Byte | Sample rate |
| 0x80 | 1 Hz |
| 0x81 | 2 Hz |
| 0x82 | 5 Hz |
| 0x83 | 10 Hz |

A third byte is then used to start (0xF1) or stop (0xF0) transmission. Upon receipt of the start byte, the microcontroller 208 repeatedly transmits to the serial port 210 the 16-bit formatted digital sensor data value for each of the sensors selected in the sensor selection byte, and repeats this transmission at the frequency specified by the sample rate byte. Any other byte received by the microcontroller 208, such as 0x0F, cause the microcontroller to halt processing and reset to its initial idle state.

The MRU 204 combines a general purpose microprocessor and RAM memory 218 with a serial (or USB, as appropriate) interface 216 to the SCU 202. Data can be sent and received over this port asynchronously to and from a reciprocal port 210 on the SCU 202. The microprocessor 218 is further connected to local permanent storage facility 222 in which received data can be stored in selected files. A variety of suitable permanent storage options are commercially available, all of which combine small size and low power consumption with high reliability and high capacity. Particularly suitable are "disk on a chip" products, such as the DiskOnChip Millennium Plus product available from M-Systems of Newark, Calif. The microprocessor 218 can also communicate through additional interfaces for external communications. Typically provided are a serial port 220 and an Ethernet™ port 224.

Figure 3:
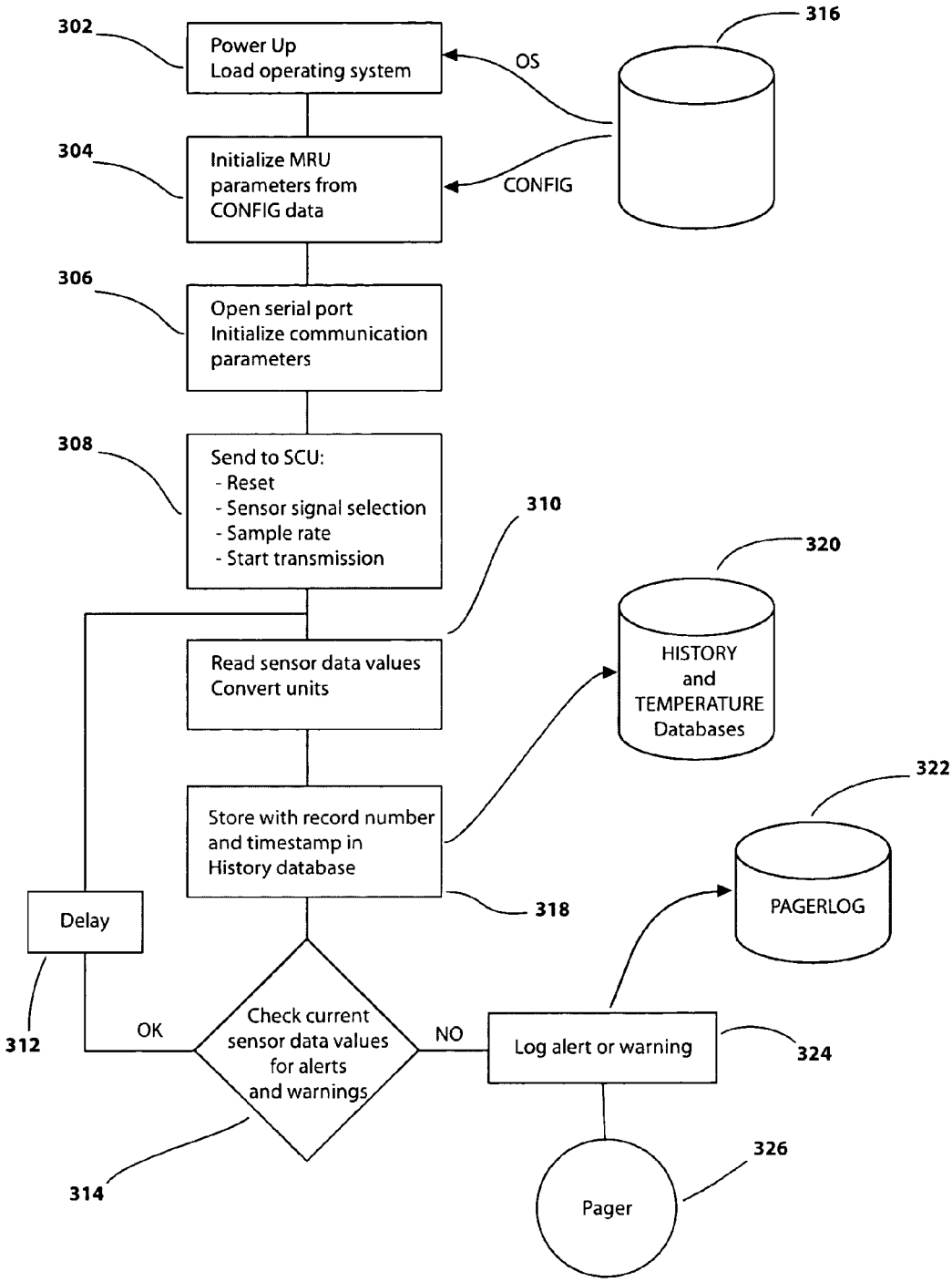
FIG. 3 is a schematic flowchart representing the operation of the software in the alarm, monitoring and reporting unit.

With reference to FIG. 3, on power-up, the operating system and MRU monitoring software are automatically loaded (step 302) from files 316 resident on a permanent storage medium or facility. The MRU monitoring software performs the following functions:

(1) The contents of one or more configuration files are read and their contents used to set configuration parameters 304 used by the MRU software. Typically, the configuration parameters pertain to either the site or the particular unit of refrigeration equipment. The tables below, collectively referred to as the CONFIG data, contain a selection of parameters suitable for the preferred embodiment as described herein, but it should be understood that the contents of these files may vary to suit the precise details of the implementation selected by the system designer.

(a) Parameters unique to a particular location

| | |
|---|---|
| GP | The grace period before a second paging call is made. |
| $F_1$ | Frequency at which sensor values are captured from the SCU. |
| $F_2$ | Frequency at which sensor values are checked and logged in the History database. |

-continued

| | |
|---|---|
| LOC | Site location. |
| UNIT | Description of refrigeration equipment. |
| PH | Pager phone number. |
| RETRY | Number of retries to reach a technician by pager. |
| WAIT | Delay before sending retry messages to a technician. |
| COMMS | Baud rate, parity. stop bits, data bits. flow control. |
| DIAL | Modem control codes to dial out. |

(b) Parameters unique to a particular unit of refrigeration equipment.

| | |
|---|---|
| TYPE | Unit type - cooler or freezer. |
| COND | Condenser type - air-cooled or water-cooled. |
| CONTROL | Regulation - pressure alone, temperature alone or both. |
| DEFROST | Defrost type - pump down electric, electric, hot gas or air. |
| SS | Sensor signals to monitor. |
| PA | Parameters to convert of ammeter sensor values to amperes. |
| PV | Parameters to convert of voltmeter sensor values to volts. |
| PHP | Parameters to convert condenser pressure sensor values to psi. |
| PLP | Parameters to convert evaporator pressure sensor values to psi. |
| $V_{max}$, $V_{min}$ | The maximum and minimum line voltages typically expected. |
| $A_{max}$ | A maximum value of the current drawn by the compressor as it starts up. |
| $A_1$ | Duration of normal maximum current draw $A_{max}$ during start-up. |
| $LP_{min}$, $LP_{max}$ | The lowest (and highest) pressures to be reasonably expected in the evaporator before the compressor shuts off (or starts up). |
| $HP_1$, $HP_2$ | Reasonable and maximum upper values for the pressure in the condenser during compressor operation. |
| $D_{min}$, $D_{max}$ | The lowest and highest defroster currents to be expected. |
| $ON_{avg}$ | The average on-cycle duration. |
| $ON_1$, $ON_2$ | Factors used to calculate a reasonable upper limit and maximum acceptable duration of the compressor's on-cycle. |
| $ON_3$, $ON_4$ | Factors used to calculate a reasonable lower limit and minimum acceptable duration of the compressor's on-cycle. |
| $OFF_{avg}$ | The average compressor off-cycle duration. |
| $OFF_1$, $OFF_2$ | Factors used to calculate a reasonable upper limit and maximum acceptable duration of the compressor's off-cycle. |

(2) The serial port 216 (FIG. 2) is opened for asynchronous communication (step 306 in FIG. 3) with the SCU 202. The communication parameters contained in the COMM parameter are used to initialize the serial port 216.

(3) Configuration data is sent (step 308) to the microcontroller 208 (FIG. 2) via the serial port 216. The configuration data typically includes bytes to reset the microcontroller (0x0F), set the sensor signal selection (0xDF), set the sample rate (0x83) and start transmission (0xF1).

(4) At suitable intervals, as determined by the $F_1$ frequency parameter from the CONFIG data, the 16-bit digital sensor values provided by the SCU 202 for each selected sensor are read (step 310) from the serial port 216 and converted to more usual units (that is, pressures in pounds per square inch in U.S. practice, currents in amperes and voltages in volts). The conversions make use of the PA, PV, PHP and PLP constants contained in the CONFIG data.

These step 310 values, together with a unique key comprising a record sequence number and a timestamp, are stored (step 318) in a History database 320 stored in the permanent storage facility 222. For ease of reference, values stored in the History database corresponding to a particular time period are shown with a "t" subscript (that is $V_t$, $A_t$, $D_t$, $T_t$, $LP_t$ and $Hp_t$).

Additionally, during step 310, values of the temperature T at 8 hour intervals for typically the past 30 days are stored in a file in the permanent storage facility 222.

Optionally, the digital sensor values obtained at step 310 may also be displayed on a terminal monitor (not shown as such) attached to the MRU.

(5) Each set of digital sensor values is checked (step 314) by the MRU software for warnings or, more seriously, alerts. A number of the checks described below involve a comparison of present values with threshold or normal or reference values of various selected parameters. These threshold or normal or reference values are all provided from the CONFIG data, described above, where they have either been set by a technician, the system designer based on manufacturer's recommendations or have been measured by means of the learning mode of the system (described in (8)(c) below), and preferably have been adjusted and updated based upon an analysis of the monitored equipment and its installation, knowledge of analogous systems, and experience. The preferred performance checks for AC-powered refrigeration equipment are the following:

(a) Check voltage

| Event | Test |
|---|---|
| Power outage alert | $V_t = 0$ and $V_{t-1} \neq 0$<br>The voltage has fallen from a non-zero value to zero. |
| Power restored warning | $V_t \neq 0$ and $V_{t-1} = 0$<br>The voltage in the previous period was zero and the voltage in the current period has now risen above zero. |
| High voltage warning | $V_t > V_{max}$ and $V_{t-1} > V_{max}$<br>The voltage has risen too high in two consecutive periods. |
| Low voltage warning | $V_t < V_{min}$ and $V_{t-1} < V_{min}$<br>The voltage has fallen too low in two consecutive periods. |

(b) Check compressor operation

| Event | Test |
|---|---|
| Locked rotor amperage alert | $A_t = A_{max}$ for $A_1$ seconds.<br>The compressor has drawn an abnormally high current in consecutive periods. This is usually indicative of a locking of the compressor rotor. |

(c) Check compressor on-cycle

| Event | Test |
|---|---|
| Long compressor on-cycle warning | $A_t = 0$ and the compressor current $A_t$ has been non-zero for more than $ON_1 \times ON_{avg}$ periods. |
| Long compressor on-cycle alert | $A_t = 0$ and the compressor current $A_t$ has been non-zero for more than $ON_2 \times ON_{avg}$ periods. ($ON_2 > ON_1$.) |
| Short compressor on-cycle warning | $A_t = 0$ and the compressor current $A_t$ has been non-zero for fewer than $ON_3 \times ON_{avg}$ periods. |
| Short compressor on-cycle alert | $A_t = 0$ and the compressor current $A_t$ has been non-zero for fewer than $ON_4 \times ON_{avg}$ periods. ($ON_4 < ON_3$.) |

(d) Check compressor off-cycle

| Event | Test |
|---|---|
| Long compressor off-cycle warning | The compressor current $A_t$ has been zero for more than $OFF_1 \times OFF_{avg}$ periods. |
| Long compressor off-cycle warning | The compressor current $A_t$ has been zero for more than $OFF_2 \times OFF_{avg}$ periods. $OFF_2 > OFF_1$ |

(e) Check compressor low pressure

| Event | Test |
|---|---|
| No refrigerant pressure alert | $LP_t = 0$<br>There is no refrigerant pressure on the intake side of the compressor. |
| Cut out pressure too low warning | $LP_t < LP_{min}$ and $A_t \neq 0$<br>The pressure on the intake side of the compressor has fallen too low and the compressor is still pumping. |
| Cut in pressure too high warning | $LP_t > LP_{max}$ and $A_t = 0$<br>The pressure on the intake side of the compressor has risen too high and the compressor has not yet started. |

(f) Check compressor high pressure

| Event | Test |
|---|---|
| High pressure warning | $HP_t > HP_1$ and $A_t \neq 0$<br>The compressor is pumping and the pressure on the condenser side of the compressor has risen too high. |
| High pressure alert | $HP_t > HP_2$ and $A_t \neq 0$<br>The compressor is pumping and the pressure on the condenser side of the compressor has risen dangerously high. |

(g) Check defroster operation

| Event | Test |
|---|---|
| High defroster current warning | $D_t > D_{max}$<br>The defroster is drawing an unexpectedly high current. |
| Low defroster current warning | $D_t < D_{min}$<br>The defroster is drawing an unexpectedly low current. |

Note that the performance checks can be made in a number of different ways. For example, the check for the locked rotor amperage reads:

$$A_t = A_{max} \text{ for } A_1 \text{ seconds}$$

The particular way in which this is carried out may vary at the discretion of the designer. The preferred technique as is described in this specification is based on the assumption that the values needed to carry out the test are available in a historical time series database. On this premise, one of a number of ways in which the performance check could be done is by following this measurement/logic sequence:

Is the value in the current period equal to $A_{max}$?

If so, examine the values of the amperage values stored during the past $A_1$ seconds. If they are all equal to $A_{max}$, then the check is satisfied and a locked rotor amperage alert should be signalled.

However, it will readily occur to those skilled in the technology that one might use a different procedure for establishing the $A_{max}$ value and comparing it to the current value $A_t$. By way of example, after establishing the $A_{max}$ value, an alternative for the locked rotor amperage check would be as follows:

Keep a count of the number of consecutive periods in which the measured current equals $A_{max}$. This could be done by storing a record that had two fields: timestamp S and count of consecutive periods N. This would be interpreted to mean that the current delivered to the compressor had held at the maximum value for N consecutive periods commencing at time S.

The test according to this alternative procedure would then be: Has N (in seconds) exceeded $A_1$? If so, then a compressor high-amperage alert would be sent to the receiver (e.g., a technician's monitor or pager).

Note that while as an example the above discussion has made use of the particular performance check on the basis of which the locked compressor rotor amperage alert might be transmitted, similar variants or substitutes could be readily devised for the other performance checks. Further alternative performance check methodology will readily occur to those skilled in the technology.

(6) If any of the checks detect a fault (either a warning or an alert), a message is sent to the pager 326 of a service technician. With reference to FIG. 2, the alert or warning message is sent via the serial port 220 and modem 226 over a telephone line 228 to the pager 232 (incorporating its own modem 230) of a service technician. The message includes:

the site location (LOC from the CONFIG data);

the unit number describing the refrigeration equipment (UNIT from the CONFIG data);

the sensor value that has triggered the fault; and an appropriate message identifying the warning or alert.

Every message that is sent to a pager is logged 324 in a file ("PAGERLOG") located on the permanent storage 222. Each message is logged with a timestamp of when it was sent, a count of the number of times it was sent, and a placeholder for the timestamp of when a technician responded.

Further messages are sent to the service technician's pager if:

the period specified by the WAIT parameter (from the CONFIG file) has expired;

there has not been a response from a technician (that is the technician's response timestamp in the PAGERLOG file has not been completed); and the number of retries to be attempted (as specified by the RETRY parameter from the CONFIG file) has not been exceeded.

(7) The MRU may be a single discrete composite unit providing the functions of monitoring, recording, and the sending or sounding or display of an alarm, or these functions may be distributed over a number of subunits, one or more of which subunits may be remotely located relative to one another and relative to the equipment being monitored. And all or part of the MRU apparatus may be provided at more than one location, depending upon requirements. If a service technician is constantly monitoring the data compiled and displayed by the MRU, an alarm may be redundant. The specific choice of MRU or MRUs and the functionality of same are within the discretion of the designer, installer and user of the monitoring systeme according to the invention. The arrangement of FIG. 2 is suitable for many installations.

With reference to FIG. 2, at any time, and particularly in response to a page received from the MRU, a service technician can connect a conventional personal computer ("PC", not shown) running monitoring software (the "PC Monitor") 240 to the MRU 204. Note that depending upon the installation, a so-called "dumb terminal" could be substituted for the PC Monitor 240; in some cases, a passive display monitor, perhaps with the addition of an alarm, may be all that is required. However, the use of a PC with a PC Monitor permits a high degree of interactivity between the MRU and the technician monitoring the refrigeration equipment, and will in many cases be preferred.

The connection between the MRU 204 and the PC Monitor 240 can be effected in a number of ways, all of which are conventional. If the service technician comes to the site at which the monitoring event has occurred, the PC Monitor 240 can be connected directly to the serial port 220 on the MRU 204 with an appropriate standard serial cable 242. Alternatively the technician can connect the monitoring PC from a remote location to a serial port 220 on the MRU 204 by a dial-up modem connection (using modems 234 and 238 over the telephone network 228). Lastly, where an internet connection 244 is available at the site of the refrigeration unit, a remote connection can be made from the PC Monitor 240 to an Ethernet™ port 224 on the MRU 204.

The details of the communication and the protocols used between the PC and the MRU rely on conventional techniques and can be varied to meet the needs of individual sites.

(8) The PC Monitor 240 provides the following capabilities for service technicians:

(a) Notification of service call

The service technician can notify the MRU 204 that the warning or alert has been received and a service call is underway. This is done by the PC Monitor software by sending a request to the MRU software that the technician's response timestamp in the PAGERLOG file be updated to show that the service technician has begun looking at the problem.

(b) Maintenance and synchronization of the CONFIG file.

Both the PC Monitor and the MRU software need to use the same set of configuration parameters as are set out for the CONFIG data in (1) above.

Figure 4:
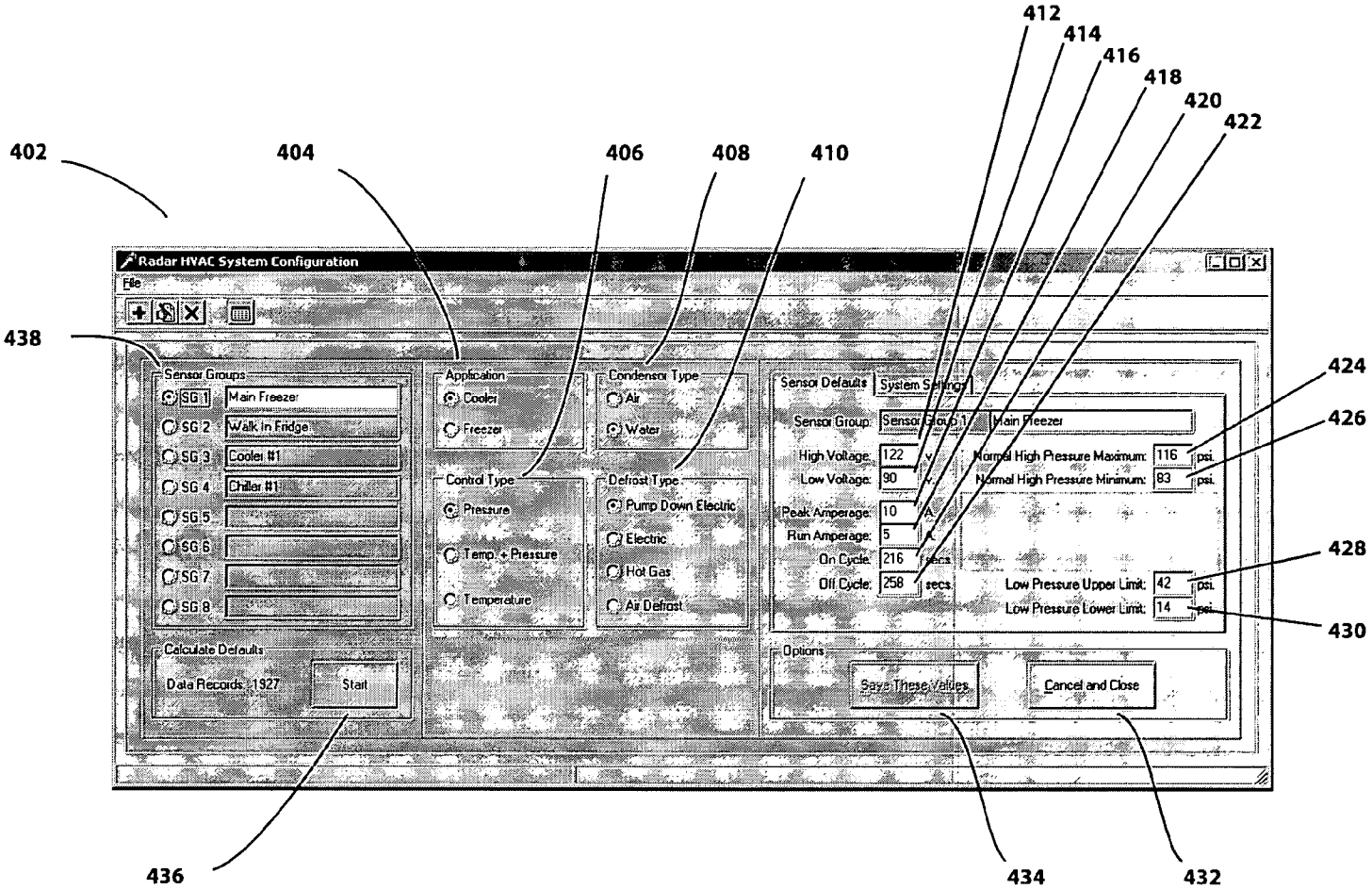
FIG. 4 is a reproduction of a PC computer monitor display representing the screen layout used to set a selection of configuration parameters relevant to the particular refrigeration unit, for use by the software in the alarm, monitoring and reporting unit and the PC Monitor.

The PC Monitor provides appropriate screen edit boxes for a technician to manually enter or revise all of the configuration parameters. These edit boxes are typically organized for convenience on more than one screen. FIG. 4 shows the layout of the configuration parameters appearing on an exemplary such screen shown generally as 402. The values displayed as selections 404 to 410 and in the edit boxes 412 to 430 are all specific to the particular refrigeration unit selected from the "Sensor Group" section 438. Alternatively, as is described below, the technician can run the PC Monitor in "learn" mode for a suitable period, typically 24 hours, to calculate a selection of the parameters from actual observations of the refrigeration unit's operation.

Figure 5:
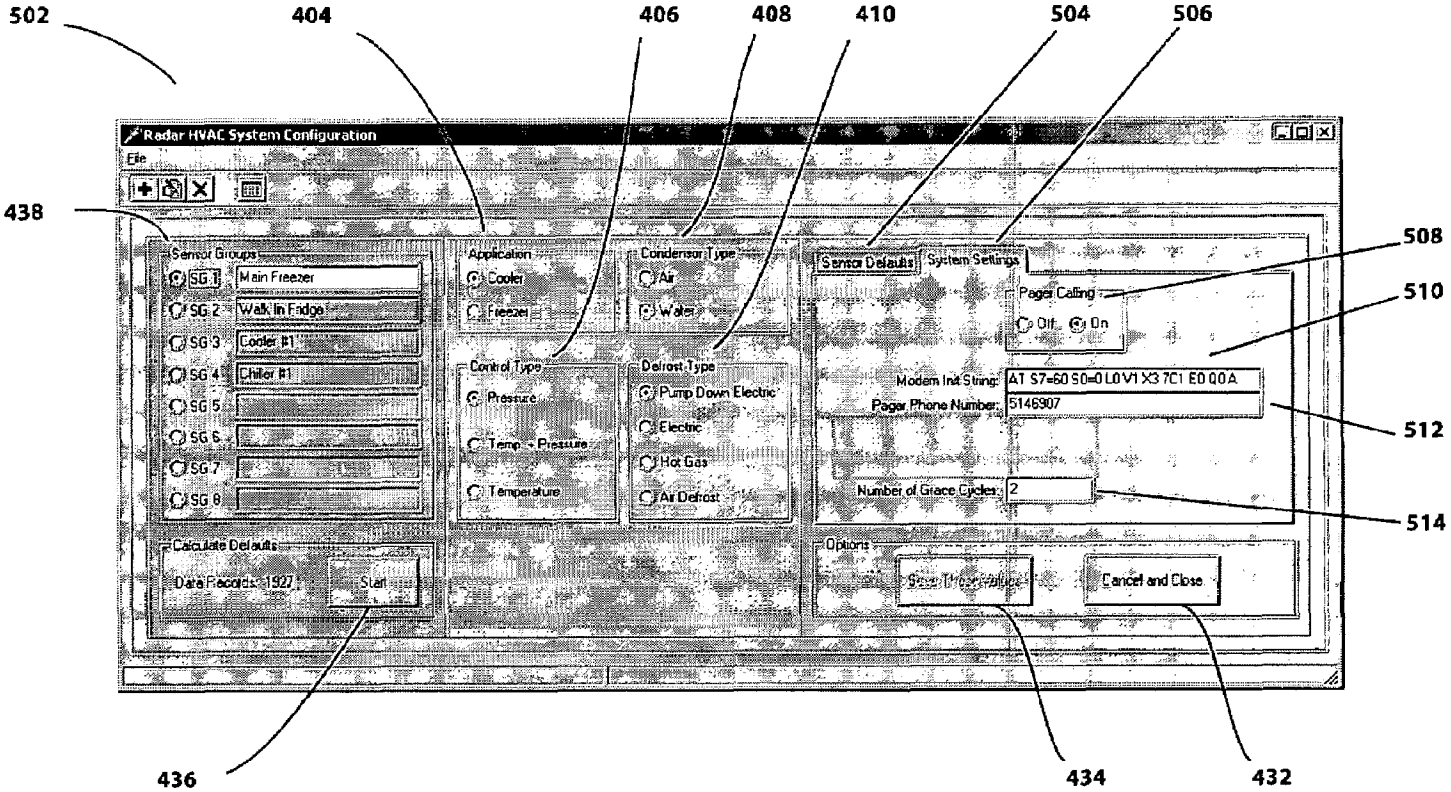
FIG. 5 is a reproduction of a PC computer monitor display representing the screen layout used to set a selection of configuration parameters relevant to the installation as a whole, for use by the software in the alarm, monitoring and reporting unit and the PC Monitor.

FIG. 5 shows a second screen 502 for setting a selection of the configuration parameters. Typically, this screen is the same as that of FIG. 10 with the panel having the tab "Sensor Defaults" 504 being overlayed with a panel having an identifying tab "System Settings" 506. In the "System Settings" region of the screen there is a selection box 508 to turn pager calling on or off and edit boxes to set values for the modem initialization string 510, the pager phone number 512 and the number of grace cycles 514.

Further parameters contained in the CONFIG data are set on other screens (omitted for brevity) similar to those shown for FIGS. 4 and 5.

The PC Monitor allows the technician to:

upload the contents of the CONFIG data located on the permanent storage attached to the MRU (not shown);

edit the values of the CONFIG parameters locally on the PC Monitor, optionally incorporating some appropriate values from "learn" mode, described below. As appropriate, the technician can choose to have these values saved locally on the PC (434 in FIG. 4) or cancelled (432 in FIG. 4);

download the values for the CONFIG parameters from the PC Monitor to one or more files located on the permanent storage found on the MRU.

use the values of the CONFIG file parameters most recently uploaded (and possibly revised) with the other functions provided in the PC Monitor software.

(c) Learning mode

In learning mode, the PC Monitor requests a feed of sensor values, during a period of satisfactory normal operation, from the MRU in the same way as is done by the real time monitor (described below). Typically this is started by a button as is shown in FIGS. 4 and 5 as 436. The digital sensor values, usually the line voltage V, the compressor current A, the defroster current D, the refrigeration chamber temperature T, the evaporator pressure LP and the condenser pressure HP, are recorded in a database on the PC's hard drive. From these values recorded over a suitable period, typically 24 hours, and at a suitable frequency, typically once per second, a selection of key operating parameters, representative of normal operation, are calculated. Typically, these include:

| | |
|---|---|
| $V_{max}$ | The maximum line voltage. |
| $V_{min}$ | The minimum line voltage. |
| $A_{max}$ | The maximum current drawn by the compressor as it starts up. |
| $ON_{avg}$ | The average compressor on-cycle duration. |
| $OFF_{avg}$ | The average compressor off-cycle duration. |
| $LP_{min}$ | The lowest pressure observed in the evaporator before the compressor shuts off. |
| $LP_{max}$ | The highest pressure observed in the evaporator before the compressor starts up. |
| $HP_1$ | The maximum pressure in the condenser during compressor operation. |
| $HP_2$ | $1.2 \times HP_1$ |
| $D_{min}$ | The minimum defroster current drawn during defroster operation. |
| $D_{max}$ | The maximum defroster current drawn during defroster operation. |

These values are displayed on a screen (for example, FIG. 10) where they may be revised by the technician based on the technician's experience with similar equipment.

Optionally, the values may be saved, in which case the corresponding values for these parameters are updated in the CONFIG data located on the PC.

(d) Real-time monitoring

Figure 6:
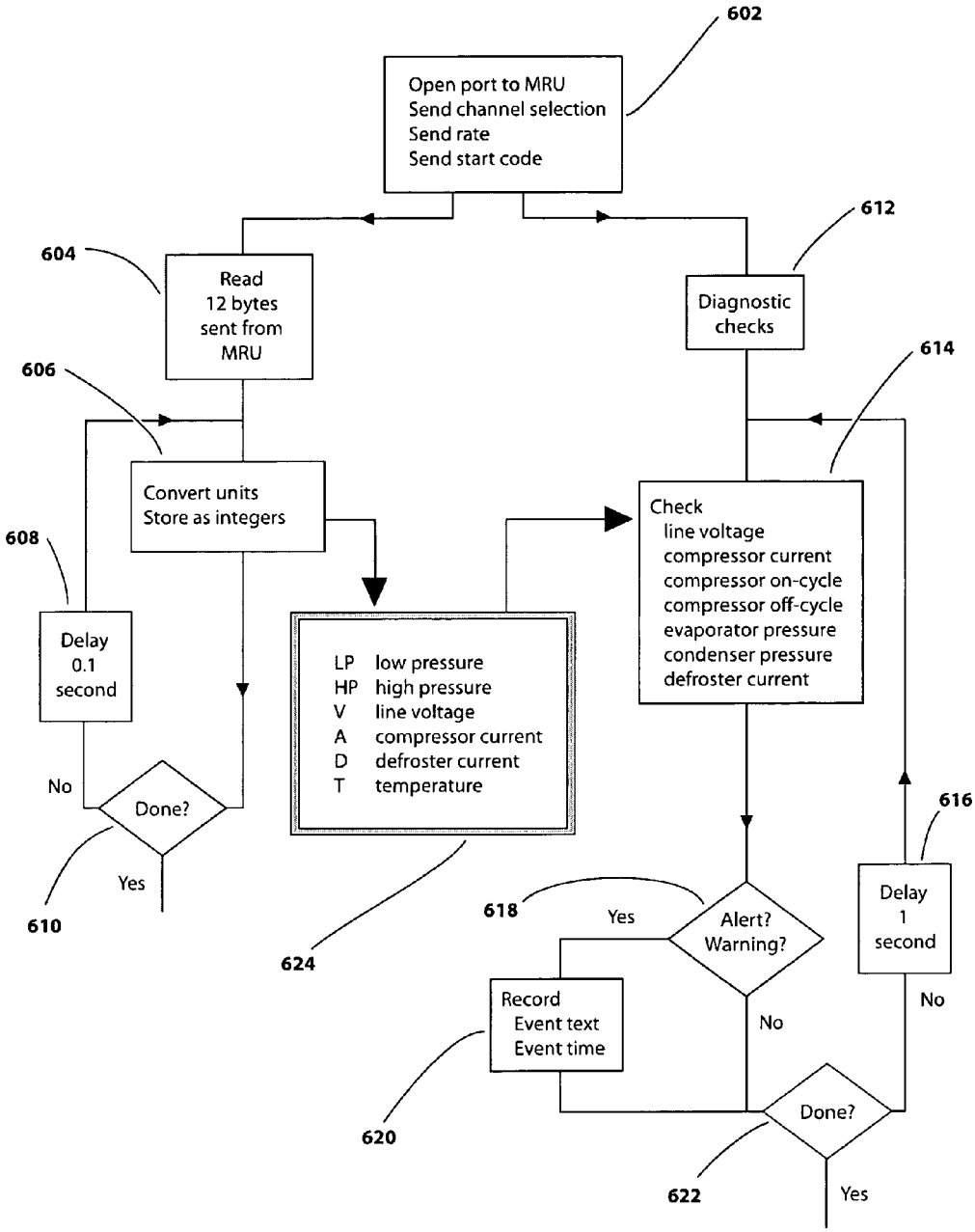
FIG. 6 is a schematic flowchart representing the operation of the real-time monitoring function of the PC Monitor software.

The technician can set the PC Monitor to report in real time on the state of a selected refrigeration unit. This function is requested by the click of an on-screen button. The typical operation of this function is shown in FIG. 6. In this mode the PC Monitor software:

requests a repeated transmission (steps 604 to 610) of digital sensor data as it becomes available at the MRU. The following description provides an overview of how this is implemented in a conventional manner with asynchronous communications.

The transmission of digital sensor data from the MRU to the PC Monitor is configured (step 602) using the same control bytes as are used by the MRU to control the SCU and which are described above with reference to FIG. 2. For example, if six sensor signals are selected for transmission 10 times per second, the PC Monitor will receive 12 bytes (step 604) from the buffer (not shown) attached to its serial port and after subsequent delays of 0.1 second (step 608) can expect to find a further 12 bytes waiting in the serial port's buffer on each iteration. This data feed continues until the technician intervenes to stop the feed (step 610) by clicking on an on-screen button (not shown). The MRU receives notification to stop transmission by the receipt from the PC Monitor of the stop byte (0xF0).

In step 606, each set of values for the sensor signals are converted to their more normal units (that is pressures in pounds per square inch, currents in amperes and voltages in volts) using the currently active values for the PA, PV, PHP and PLP configuration parameters. The resulting values are placed in a table in shared memory 624.

displays the converted sensor signal values on appropriate dials and meters appearing on the PC's display screen.

starts a separate thread (step 612) to apply the same diagnostic checks (step 614, essentially the same as the performance-check step 314 discussed above) to the converted sensor values stored in the shared memory 624 as are described for the SCU in paragraphs (5)(a)–(g) above. The frequency at which this is done is determined by the $F_2$ configuration parameter. For example, FIG. 6 shows the logic flow with a one second delay (step 616) between diagnostic checks.

Record in a log (step 620) on the PC Monitor's display screen the descriptive text and time of occurrence of any warnings or alerts that are detected (step 618).

Visually highlight on the PC Monitor display, by way of easily recognizable icons or other suitable means, that a new warning or alert has occurred.

Continue monitoring sensor values in real time until the technician intervenes to stop the process (step 622).

Figure 7:
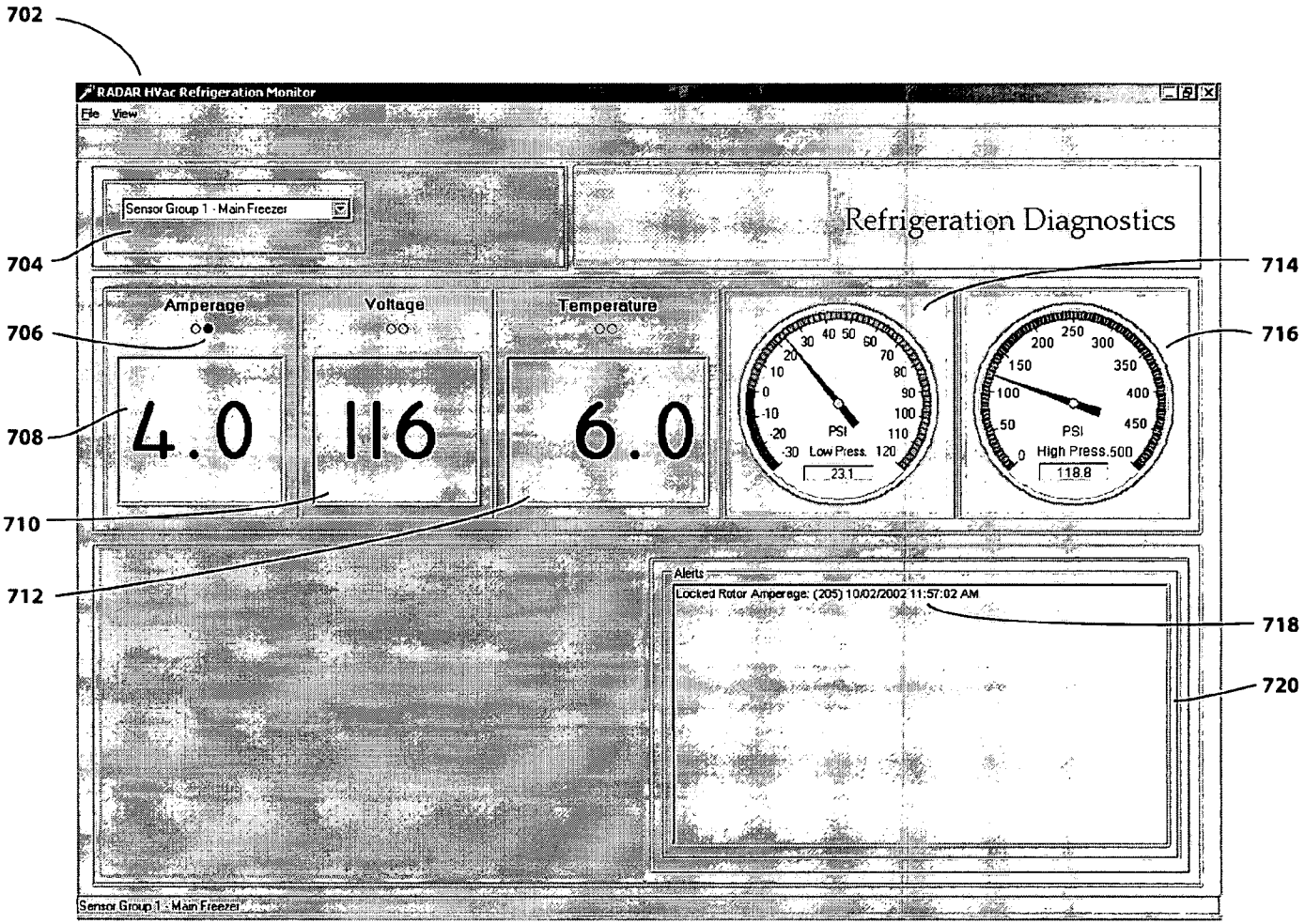
FIG. 7 is a reproduction of a PC computer monitor display representing the output of the PC Monitor software operating in real-time monitoring mode.

FIG. 7 shows a sample image 702 from a display screen during the operation of the PC Monitor. This image displays the sensor values converted to regular units for one particular refrigerator unit 704 ("Sensor Group 1—Main Freezer"). To appear as familiar as possible to service technicians, the values for the compressor current A 708, line voltage V 710 and refrigerated compartment temperature T 712 are shown as digital instruments; the values for the compressor low pressure LP 714 and compressor high pressure HP 716 are shown as circular dial instruments. The instruments (708 to 716) are selected to be large in size to assist in viewing their values at a glance from a distance.

When the PC Monitor detects a fault condition, text 718 describing the type of event, the event's sequence number and its time of occurrence are displayed in a scrollable window 720. A flashing warning light 706 is turned on at the same time.

(e) Review History database

The History database held in the permanent storage (222 in FIG. 2) contains records of the sensor values uniquely identified by a record sequence number and timestamp. The time range of the historical values stored depends on the amount of permanent storage 222 space available and the frequency with which sensor values are recorded. Typically the sensor values included are the line voltage V, the compressor current A, the defroster current D, the refrigeration chamber temperature T, the evaporator pressure LP and the condenser pressure HP. By way of example, historical data may be kept at one-second intervals for the previous 4 days.

Figure 8:
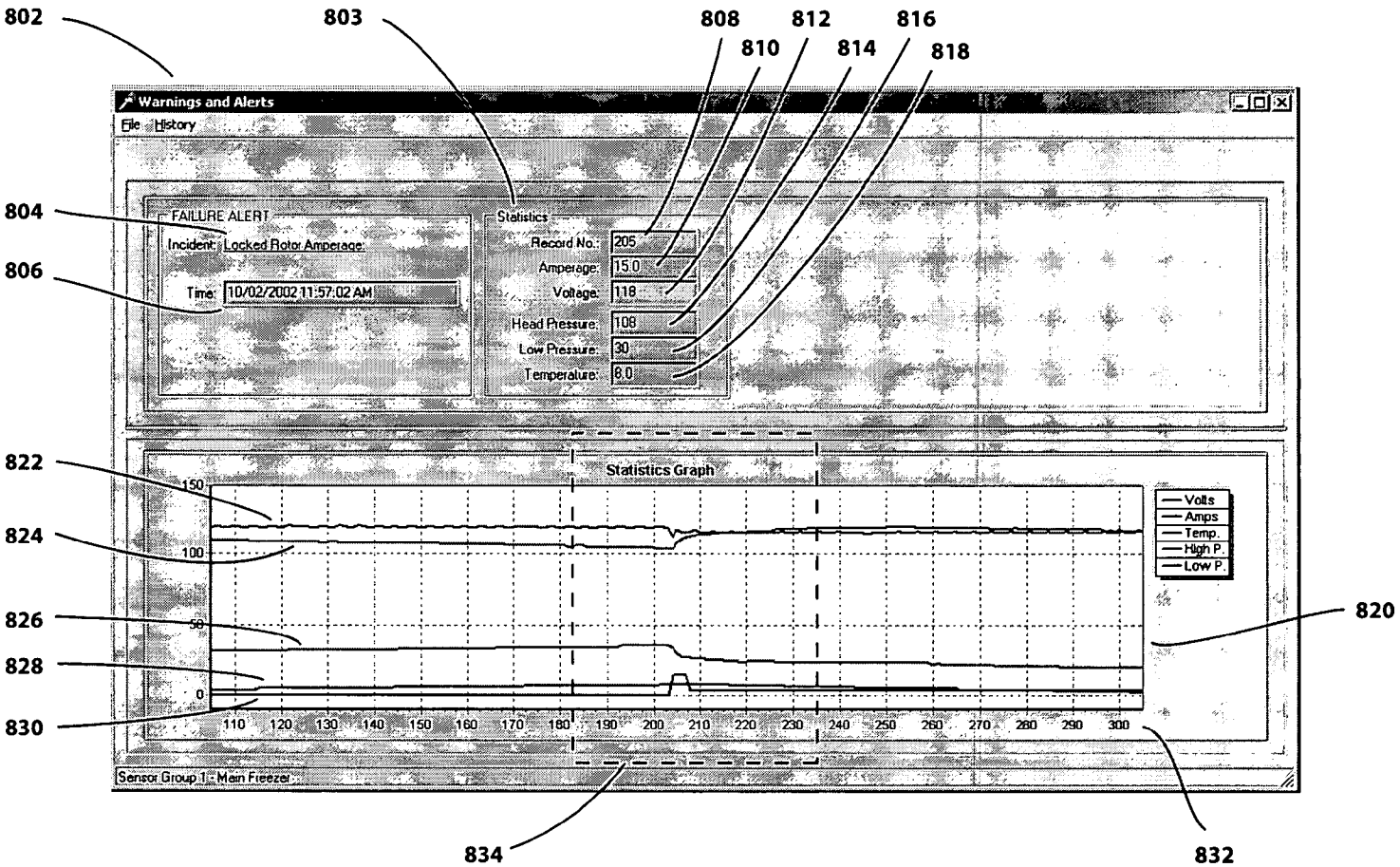
FIG. 8 is a reproduction of a PC computer monitor display representing the output of the PC Monitor software in chart display mode, the monitor displaying a chart of sensor values for a representative detected alert.

The service technician can request the retrieval of either a selected group of records from the History database or the entire History database. Typically, a subset of the records is selected to provide a one-hour window both before and after a known alert or warning. After the transfer of these records, the historical snapshot can be replayed using a set of button controls that may be selected to resemble those of a cassette tape player, for example. The controls include buttons for:

skipping to a particular record and in particular rewinding to the beginning of the retrieved historical data;

replaying the historical values as a multi-line chart. An example of a representative chart is shown in FIG. 8;

pausing or stopping the replay;

increasing or decreasing the replay speed.

The initial loading of the historical data invokes the diagnostic checks outlined above for each recorded observation. If any warnings or alerts are encountered, an appropriate message and record number are recorded in an on-screen fault list. This is particularly useful when the entire history database is processed as all warnings and alerts occurring during the recent operation of the refrigeration unit can be observed.

Double-clicking on any entry in the on-screen fault list displays more information about that fault. A sample of such a screen is shown in FIG. 8. The screen displays an identification of the fault at Incident display 804, which fault occurred at a time displayed at Time display 806. A Statistics panel 803 displays values, measured at the instant of the fault detection, of the record number (Record No. display 808), the compressor current A (Amperage display 810), the line voltage V (Voltage display 812), the compressor high pressure HP (Head Pressure display 814), the compressor low pressure LP (Low Pressure display 816) and the refrigerated compartment temperature T (Temperature display 818).

The chart 820 shows the values of selected sensor values over a period of time displayed as the abscissa 832 of the chart. The sensor values displayed are those selected by the SS parameter in the CONFIG file. In the example of FIG. 8, the sensor values selected are the line voltage V (Volts line display 822), the compressor high pressure HP (High P. line display 824), the compressor low pressure LP (Low P. line display 826), the refrigerated compartment temperature T (Temp. line display 828) and the compressor current A (Amps line display 830). Values for each sensor are displayed as a separate, distinctly colored line on the chart. (The colours of the chart lines are not shown.) The abscissa is labelled with the record number recorded in the History database corresponding to each point in time displayed. In this example, the records are recorded at one-second intervals. With this information, the technician can observe the behaviour of any of the sensor values during the period leading up to and immediately after the warning or alert.

Figure 9:
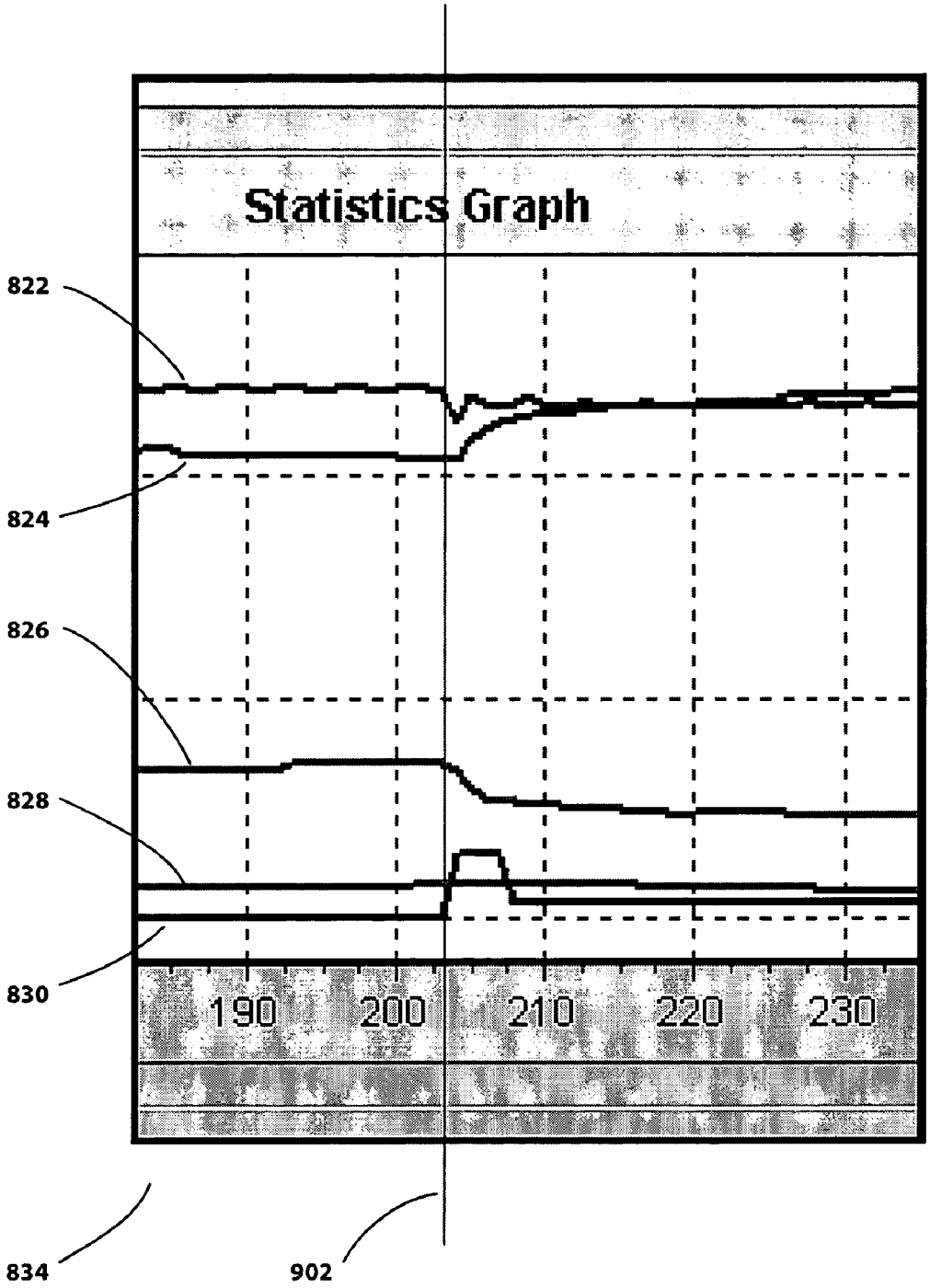
FIG. 9 is a portion of the chart display of FIG. 8, magnified in the vicinity of the alert.
Figure 10:
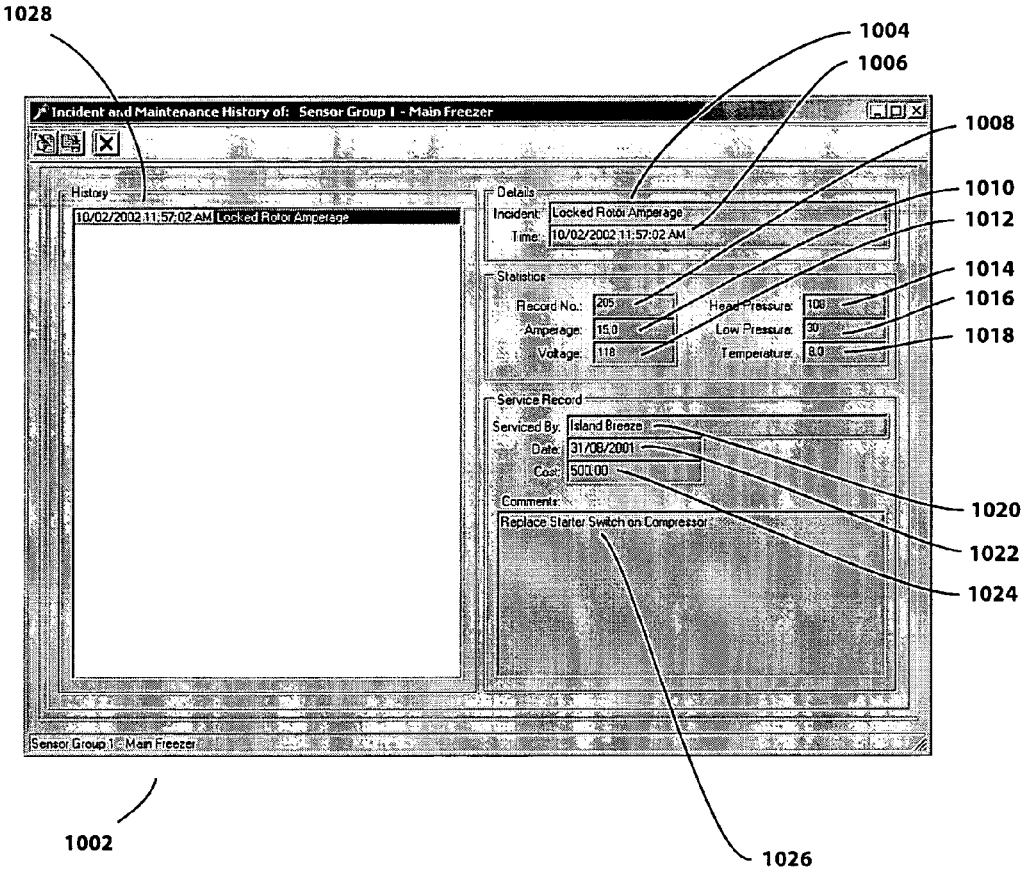
FIG. 10 is a reproduction of a PC computer display representing the output of the PC Monitor software in service-history display mode, the PC Monitor displaying a representative entry in the service history for a selected refrigeration unit.

FIG. 9 shows a portion 834 of FIG. 8 magnified for greater clarity. The line 902 corresponds to record number 203 and is superimposed on the portion of the chart 834 for ease of reference. The values of the voltage $V_{203}$ and compressor current $A_{203}$ indicate that record number 203 is the time at which the compressor motor was activated. Initially, the current $A_{203}$ drawn by the compressor 106 rises sharply and holds steady at a maximum limit (determined by the compressor manufacturer) as power is required to overcome the inertia of the compressor's components (chart line 830). Simultaneously, there was a corresponding drop in the line voltage V (chart line 822). In response to the turning on of the compressor 106, refrigerant is drawn in from the intake side and pumped out on the condenser side. This is seen in the chart 834 as a reduction of the compressor low pressure LP (chart line 826) and an increase in the compressor high pressure HP (chart line 824). Gradually, in response to the work done by the compressor the temperature (chart line 828) in the refrigerated compartment begins to fall. Under normal operating conditions, the compressor current falls back to a steady running amperage after approximately one second. However, if the compressor current (chart line 830) stays locked on at the limiting value for longer than one second, as is the case in FIGS. 8 and 9, this indicates that there is a problem with either the electrical or mechanical components used in the start-up. The selection of the value for the duration after which a fault is triggered (one second in the example above) is determined by the A, parameter set in the CONFIG data.

The detection of faults makes it possible to provide diagnostic information outlining the possible causes of the particular fault detected. Typically, such information can be provided on-screen as a list of likely causes for any selected warning or alert. Such text is kept in a database on the PC and is maintained by the designers of the system.

(f) Display refrigerated compartment temperature as a time series.

In most locations, periodic inspections by health authorities require the examination of logs of the temperature within the refrigerated compartment. The PC Monitor provides this in the form of a chart by uploading the values of the temperature T from the History database and displaying (or printing) this as a time series. Typically, values of the temperature are required three times per day for the past 30 days.

(9) A record is kept of the contractor who installed the refrigeration equipment. Pertinent details recorded include company name, contact person, address, phone number, fax number, email address. There may be several of these sets of data, one for each SCU installed.

(10) A record is kept of the service history for a site's refrigeration equipment. An example of a service record entry is shown generally as 1002 in FIG. 10. For each service visit, details recorded include: a brief description of the problem (Incident display 1004), the date and time (Time display 1006), the record number in the history file (Record display 1008), the compressor current A (Amperage display 1010), the line voltage V (Voltage display 1012), the condenser pressure HP (Head Pressure display 1014), the evaporator pressure LP (Low Pressure display 1016), the refrigeration chamber temperature T (Temperature display 1018), the name of the service technician (Serviced By display 1020), the date the service was completed (Date display 1022), the cost of the service (Cost display 1024) and additional comments (Comments display 1026).

Each record of a service call is appended to a service history (History display 1028). This data can prove to be of considerable assistance for a service technician as:

(a) situations arise where a subsequent service call is required perhaps to fix a problem situation caused by earlier inadequate service; and (b) a review of the service history may reveal consistent patterns of component failure which would otherwise go undetected.

ALTERNATIVE EMBODIMENTS

Figure 11:
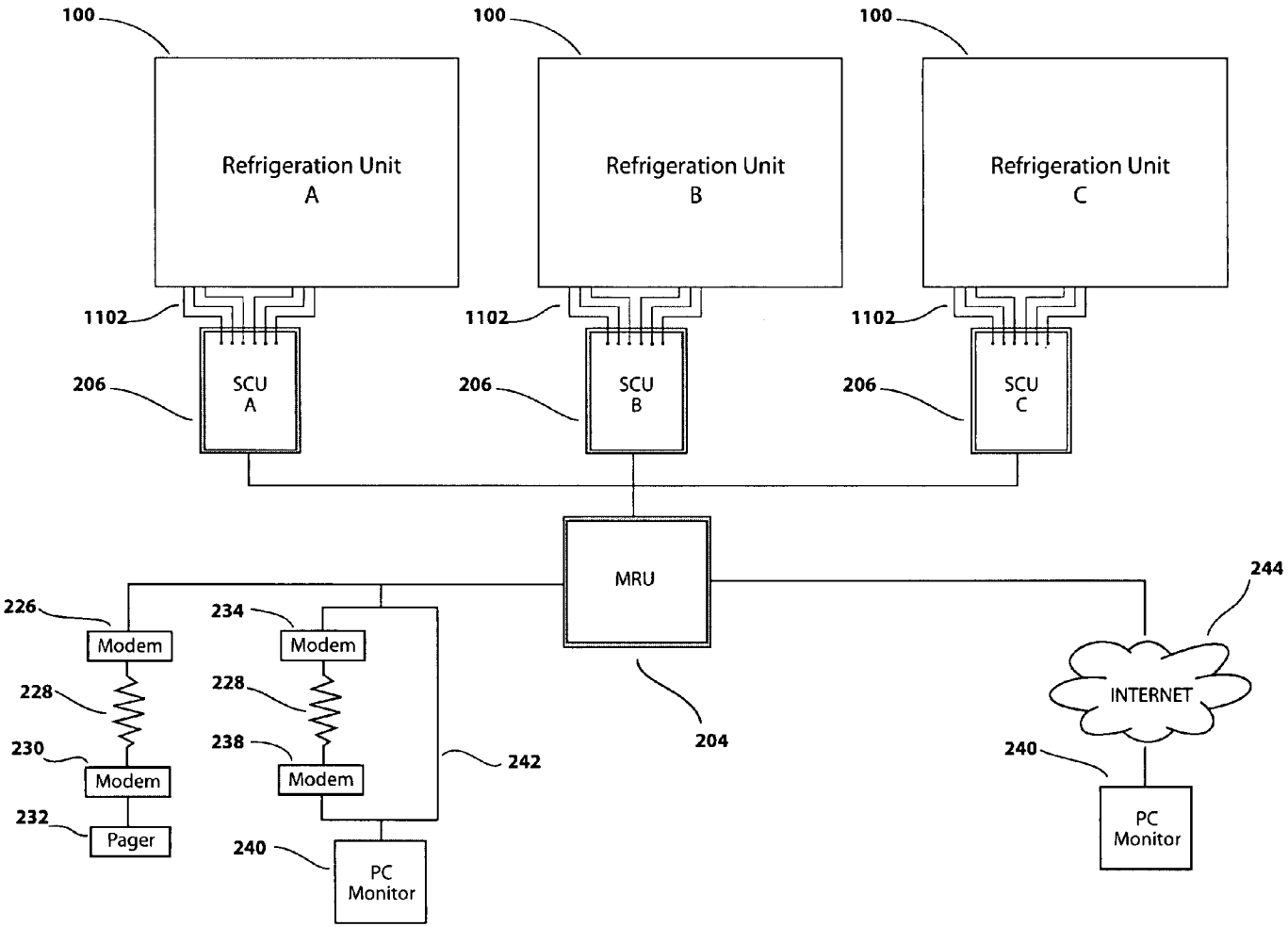
FIG. 11 is a schematic drawing showing an alternative embodiment of the invention in which more than one refrigeration unit is monitored.

FIG. 11 shows an alternative embodiment of the invention in which multiple refrigeration units are monitored. By way of example, FIG. 11 shows three such refrigeration units 100. Each refrigeration unit 100 has sensors which are connected to an SCU 206 which are in turn connected to an MRU 204.

In one embodiment, the SCUs are connected to the MRU by twisted pair wiring using the RS232 communication protocol. At suitable intervals, the MRU software polls each SCU 206 for the values of those sensors selected by the SS parameter from the CONFIG file. Each SCU 206 supplies 2 bytes of data per sensor and the resulting data from one SCU provides a record of data to be included in one of several History databases. There is a separate History database for each unit of refrigeration equipment.

In an alternative embodiment, the SCUs 206 are connected as a daisy chain along one twisted pair wire using the RS485 multidrop protocol. In this arrangement, the MRU 204 receives all the data broadcast from all the SCUs and the software is set to select samples from the SCUs at a suitable frequency.

The operation of the MRU 204 is governed in part by the values of the configuration parameters stored in one or more CONFIG files. Where there are multiple SCUs 206 connected to a single MRU 204, the software operates on a single SCU 206 at a time as selected by the service technician. The required configuration parameters for the selected SCU 206 are read in from the appropriate CONFIG file. Further, each request by the PC Monitor functions for historical data from the MRU specifies which SCU History database is to be used.

With reference to FIG. 3, sensor data values in standard units are stored 318 as time series in the HISTORY database 320. These records are subsequently used as the source of the values used in the novel performance checks 314 detailed in paragraphs (5)(a) to (g) above. However, this aspect of the invention is not to be limited by the particular scheme selected to store the sensor data values. Other embodiments employing alternative means of storing the information contained in the sensor data are possible within the scope of this aspect of the invention. For example, the performance checks can be satisfactorily executed with the following stored information (in addition to the values of the parameters in the current period):

| | |
|---|---|
| Line voltage §(5)(a) | $V_{t-1}$ Record the line voltage in the previous period. |
| Compressor current §(5)(b) | Record the time at which the compressor current most recently rose to exceed $A_{max}$. Reset this to zero to indicate that the current has fallen back below $A_{max}$. If in a particular cycle, the compressor current exceeds the maximum, the stored value is given a timestamp which could look like "20021115100256789" which is YYYYMMDDHHMMSSmmm, the last three digits being milliseconds. In the following periods, if the maximum is still being exceeded no change is made to the stored value. However, when the current falls back below the maximum, the timestamp is set to a predetermined value indicating that the condition has disappeared. The value used could suitably be "0". This remains until the maximum is again exceeded at which time, the timestamp is set to an appropriate 17 digit value. The performance check now functions by comparing the current time with the stored timestamp. If the difference exceeds the $A_1$ value obtained from the CONFIG data, then an alarm is triggered. |
| Compressor on-cycle or off-cycle §(5)(c) and (d) | Record the times at which the compressor current rises above zero (to start an on-cycle and end an off-cycle) and falls to zero (to end an on-cycle and start an off-cycle). Records having pairs of values of {timestamp, rising/falling indicator} could be stored for as much recent history as is desired by the system designer. |
| Compressor low pressure §(5)(e) | No stored historical values required as the checks rely only on values in the current period. |
| Compressor high pressure §(5)(f) | No stored historical values required as the checks rely only on values in the current period. |
| Defroster current §(5)(g) | No stored historical values required as the checks rely only on values in the current period. |

WORKING EXAMPLE

For approximately the past six months, testing in secrecy (with appropriate confidentiality restrictions) of an exemplary embodiment of a monitoring system according to the invention, including associated software, has been done. The exemplary monitoring apparatus was installed for use with a typical walk-in cooler, with interior cooling compartment dimensions of approximately 10'×12'×7.5' (approximately 3 m×3.65 m×2.3 m). The air-defrost-type cooler specifications are as follows:

Evaporator: 8000 BTU.

Condenser (water-type): 1 Hp.

Control type: Pressure Temperature.

Refrigerant Selection: R-22 (The monitoring system, however, has been designed to operate with any refrigerant type.)

Supply Voltage: 208/230 V, single-phase.

Target refrigeration compartment temperature range: 33 to 40° F. (about 0.5 to 4.5° C.).

Cooler Contents: food.

The reference above to "Pressure Temperature" control type means that the cooled space has a thermostat in series with the pressure control component located at the condensing unit. Both the thermostat and the pressure control device have the ability to turn the system on or off if exceeding set limits. For example, the high threshold temperature could be set for 35° F. above which the compressor would run, and the pressure control could be set at approximately 60 psi for cut-in and 30 psi for cut-out.

Pressure sensors were located on the high and low pressure sides of the compressor. Amperage (current), voltage and temperature transducers were connected to measure current drawn by the compressor, voltage supplied to the condenser, and temperature of the return air stream of the evaporator (located inside the cooler).

Default values generated from the Learning Mode (having accumulated 24 hours of data) were as follows High voltage: 210V.
Low voltage: 195V.
Locked-rotor current: 15 A.
Normal running load current: 2.0 A.
Compressor On-cycle: 2411 seconds.
Compressor Off cycle: 1363 seconds.
Normal High Pressure Max: 183 psi.
Normal Low Pressure Max: 66 psi.
Normal high Pressure Min: 138 psi.
Normal Low Pressure Min: 37 psi.
High pressure too high: 220 psi.
Low Pressure too low: 30 psi.
Low pressure too high: 79 psi.

Figure 12:
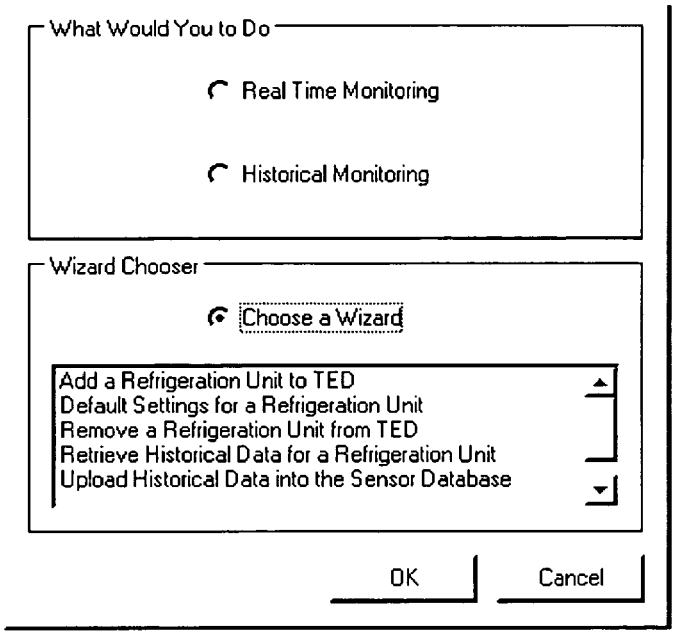
Figure 13:
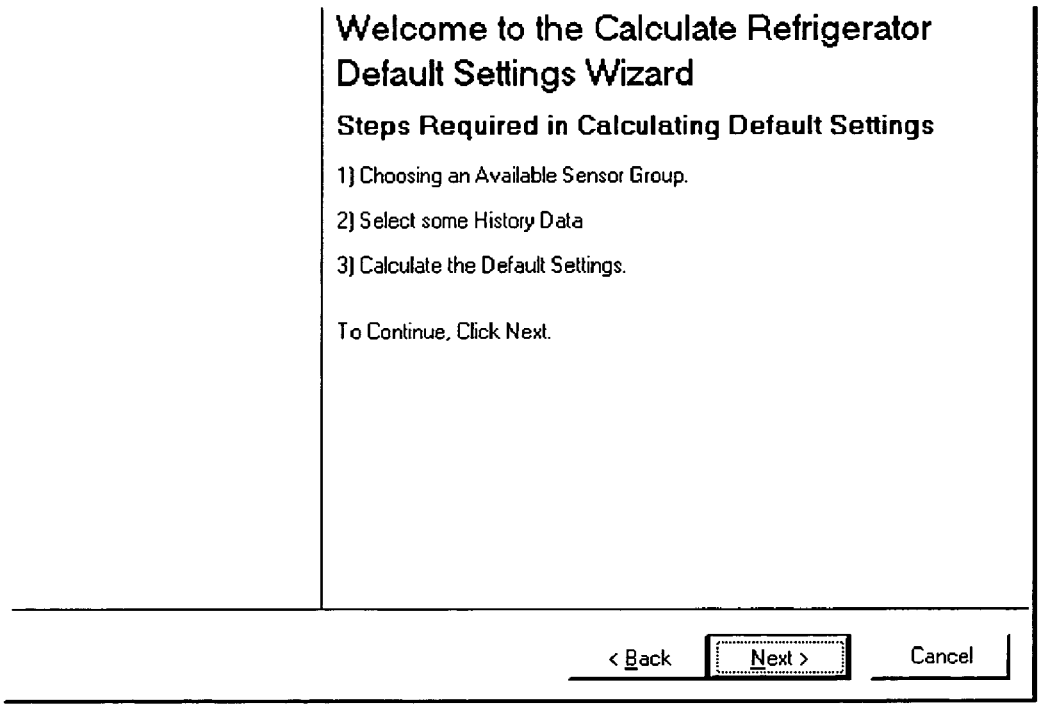

The monitoring software was chosen to operate on a conventional Windows operating system platform. The software interface application used was a wizard-driven program. A technician or other user of the monitoring system, when the application is loaded and launched, first sees the dialog box of the monitor screen print of FIG. 12. The "Wizard Chooser" presents in this example five options for adding, removing and/or configuring a monitored system or retrieving or uploading data. The next following screens show the configuration of the sample system. Each Wizard screen displays in turn the user selection options for the steps that are required in completing the user-selected task, and then the Wizard leads the user through each of those steps. The Back and Next buttons guide this process (See e.g. FIG. 13). The particular dialog box of FIG. 13 is premised on the selection by the user of the second of the five options displayed in the dialog box of FIG. 12. If the user is satisfied with the default settings and simply wants to investigate an apparent present fault condition, the user may exercise one of the last two options displayed among the total of five options displayed in the dialog box of FIG. 12.

A technician may wish to use the same interface software to monitor a number of refrigerators, coolers, etc. In this example, the monitor screen print of FIG. 14 illustrates a representative five choices. The user first selects the system that he wishes to configure, then clicks the Next button, as directed by the dialog box of FIG. 14.

Figure 16:
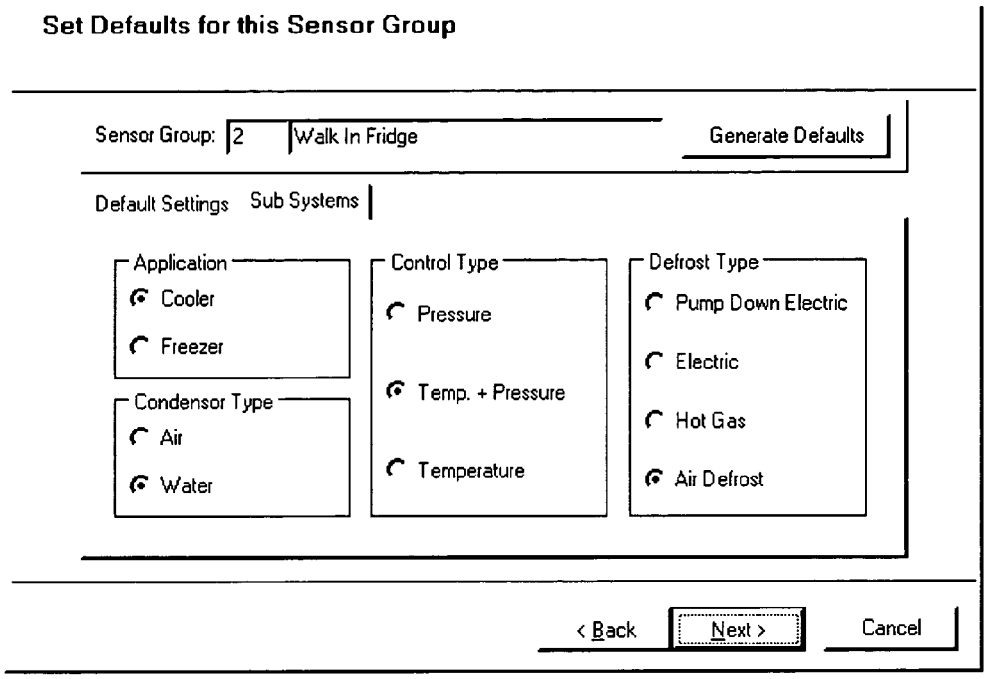

The default settings for the sample system are shown in the dialog boxes of the screen prints of FIGS. 15 and 16. The parameter values displayed in the dialog box of FIG. 15 were in this working example (and are typically) generated from a 24-hour sample set of data. However, the technician can manually edit any of the displayed values to override the default values by keying in substitute data in any data field displayed in the dialog box. The dialog box of FIG. 16 permits selection of default options for the various types of equipment and equipment components displayed.

Figure 17:
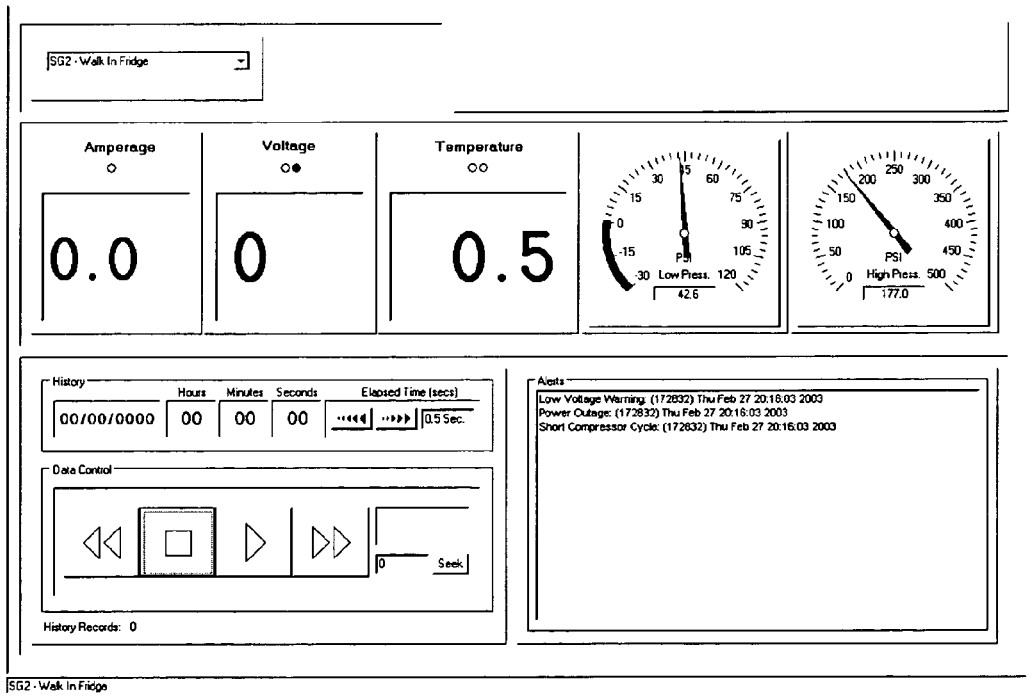

FIG. 17 is a screen print illustrating a dialog box for displaying selected present or historic parameter data. In the particular screen print illustrated, it is apparent from the voltage reading that a total loss of voltage has been detected. The Alerts box in the lower right of the screen displays three warning/alert messages reflecting possible fault conditions that were detected. These three messages are the following:

Low-Voltage: The monitoring system has detected a voltage reading below the Low Voltage threshold established by the reference values set by the system or the technician—in this example, 195V as established using the dialog box of FIG. 15.

Power Outage: The system detected no line voltage and thus generated this error message. Note that if this message is displayed, it necessarily follows that the Low-Voltage message would also be displayed.

Short Compressor Cycle: The monitoring system detected a shorter than normal On Cycle (again apparently because of the loss of power to the compressor).

Figure 18:
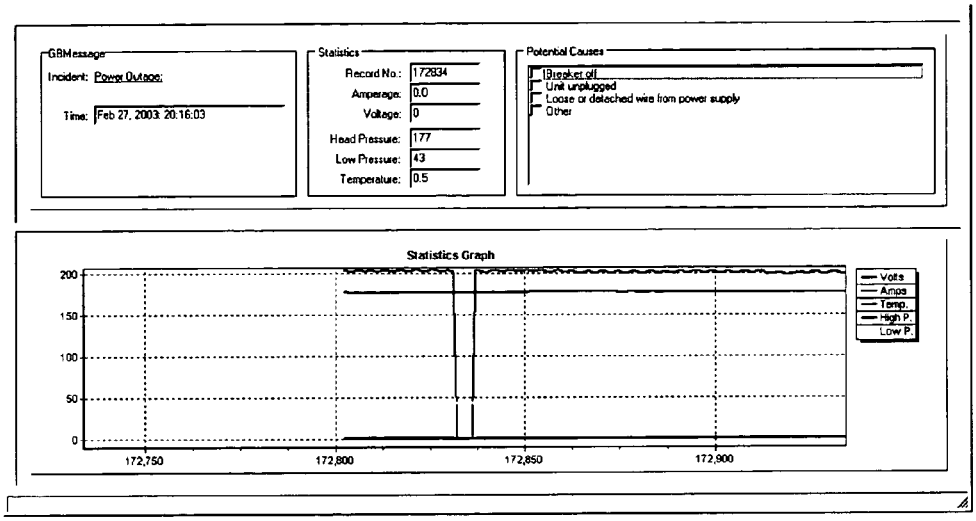

If the user double-clicks on a message field in the Alerts window of the dialog box of FIG. 17, then the screen of FIG. 18 appears and presents the user with details of the event, including a graph showing data before and after the event In this example, the loss of voltage (a drop from normal voltage to zero volts) depicts a representative malfunctioning of the monitored refrigeration equipment. This voltage drop can be simulated for test purposes simply by opening the circuit breaker for the compressor.

In the exemplary system, any time a message is generated to appear in the Alerts box of FIG. 17, concurrently a fault-condition alert or warning message is transmitted to the attending technician's pager. The technician in response to such message can then proceed to examine the historic data using the screen interfaces of FIGS. 17 and 18 for further assistance in diagnosing the apparent fault condition.

Figure 19:
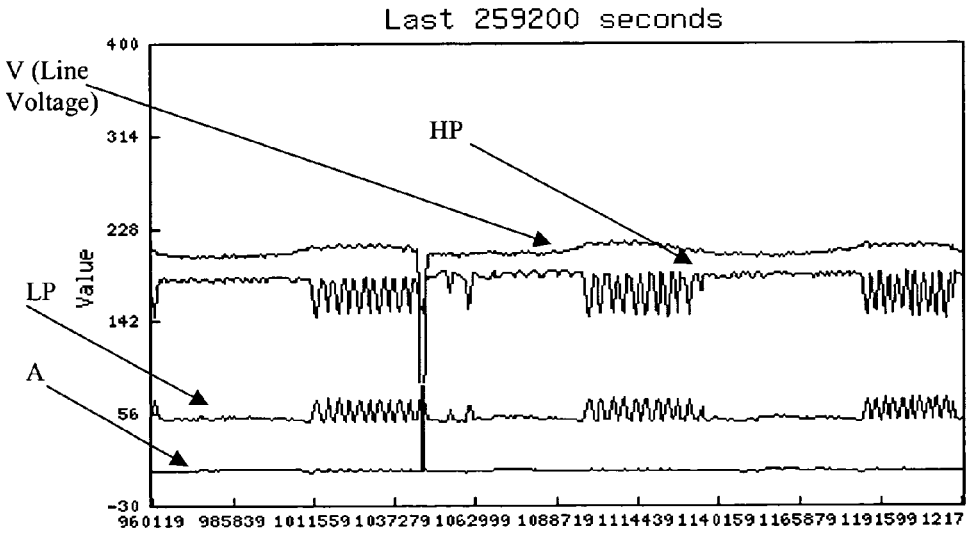

In the set of graphs displayed in the historic parameter data display box of the monitor screen print of FIGS. 18 and 19, the following graphs appear:

First (top) line: Supply Voltage.
Second line: High Pressure HP.
Third line: Low Pressure LP.
Fourth (bottom) line: Current Draw of the Compressor.

Normally the refrigerated space temperature would also appear in the graphs of FIGS. 18 and 19.

The warning/alert messages of FIG. 17 and the associated graph display of FIG. 18 alerted the technician to three areas of concern all attributable to the loss of line voltage. Apart from any alert/warning messages, an inspection of the historic data graphs can reveal fault conditions. For example, referring to the historic data graph appearing in the screen print of FIG. 19, it can be seen that the High Pressure (HP) and Low Pressure (LP) plots are significantly inconsistent from left to right across the graph, which inconsistency reveals a potential fault. In the graph of FIG. 19, approximately three days' data are displayed. The graph reveals high head pressure readings and long daytime compressor cycles. The three sawtooth patterns in the high-pressure (HP) parameter plot and the corresponding three sawtooth patterns in the low-pressure (LP) parameter plot represent a series of sequential on-off cycles of the compressor during the night. But very long almost continuous compressor on-cycles were observed during the intervening daytime periods—the compressor was running almost all of the time. These displayed data prompted the attending technician to visit the site at which the monitored refrigeration equipment was located. The very severe voltage drop at the end of the first sawtooth was caused by the opening of the circuit breaker by the attending technician.

The attending technician discovered on-site that the site had undergone some minor renovations in the course of which some rerouting of the water supplied to the water-cooled condenser had occurred. When the dishwasher and spray wand supplied by the same water supply on premises were operated, the condenser was being 'starved' of cooling water. The remedy for the problem in this case was a plumbing remedy. The attending technician by on-site inspection also discovered low refrigerant levels in the system. This discovery occurred well in advance of what would have been discovered without the warning/alert message. The technician was also able to identify a problem with the thermostatic expansion valve. This was causing the system to run inefficiently because the compressor was not running at full capacity (indicated by relatively low current draw at the compressor). Many refrigerators include a superheat setting; in this example, a minor adjustment to the superheat setting solved this problem. Repair of the leak was made and the owner was briefed on the water flow problem. It is significant to note that the actual temperatures inside the cooling chamber never exceeded the safe limits even though the system was verging on breakdown.

Note that the ordinates of the graphs of FIGS. 18 and 19 are different from one another. Preferably the user has the capability in the software set-up to adjust the range and resolution of the ordinate for optimum display of the data on-screen. Note, for example, that the visible variance of the compressor current is small in these graphs; it would be improved by a change in scale of the ordinate for compressor current.

We claim:

1. Apparatus for monitoring refrigeration equipment or the like powered by electricity supplied by a suitable source, said refrigeration equipment or the like comprising an electrically powered compressor, an evaporator, a refrigeration chamber and an electrically powered defroster; said monitoring apparatus in operation periodically sensing the values of a selected group of operating parameters of the equipment, providing output data representative of the sensed values, and performing a series of equipment performance checks or tests on the output data thereby to identify existing or incipient problems with the equipment; characterized in that the monitoring apparatus is provided with sensors and sensed parameter data value inputs obtained from the sensors associated with the selected group of operating parameters, and that the said selected operating parameters include at least the following parameters:

(a) the line voltage of the source of electricity;
(b) the current drawn by the compressor;
(c) the condenser pressure;
(d) the refrigeration chamber temperature;
(e) the evaporator pressure; and
(f) the defroster current.

2. Apparatus for monitoring refrigeration equipment or the like powered by electricity supplied by a suitable source, said refrigeration equipment or the like comprising an electrically powered compressor, an evaporator, a refrigeration chamber and an electrically powered defroster; said monitoring apparatus in operation periodically sensing the values of a selected group of operating parameters of the equipment, providing output data representative of the sensed values, performing a series of equipment performance checks or tests on the output data thereby to identify existing or incipient problems with the equipment, and providing alerts or warnings for selected ones of the existing or incipient faults as (i) a high-alert signal if, for each such selected fault, the associated monitored parameter or parameters are of values that exceeds or falls below, as the case may be, a predetermined critical threshold as measured at a predetermined time or over a predetermined time interval thereby indicating that the fault condition is critical, and (ii) a low-warning signal if an existing or incipient fault condition is detected but the associated monitored parameter or parameters are of values that fail to cross the predetermined critical threshold; characterized in that the monitoring apparatus is provided with sensors and sensed parameter data value inputs obtained from the sensors associated with the selected group of operating parameters, and that the said selected operating parameters include at least the following parameters:

(a) the line voltage of the source of electricity;
(b) the current drawn by the compressor;
(c) the condenser pressure;
(d) the refrigeration chamber temperature;
(e) the evaporator pressure; and
(f) the defroster current and that the selected performance checks include checks of the defroster current to reveal an existing or incipient fault condition that the defroster current is too high or too low, as compared with predetermined defroster current high and low threshold values.

3. Apparatus for monitoring refrigeration equipment or the like powered by electricity supplied by a suitable source, said refrigeration equipment or the like comprising an electrically powered compressor, an evaporator, and a refrigeration chamber; the monitoring apparatus comprising in combination, a sensor for continuously or continually sensing the value of each said parameter; a discrete signal collection unit connected to each said sensor for providing over time a stream of digital parameter data representative of a series of sensed values of the parameter with which such sensor is associated; a general-purpose computer for coordinating the operation of the sensors and signal collection units and performing a series of performance checks on the equipment using the digital parameter data thereby to identify existing or incipient fault conditions in the equipment; data storage means for storing selected data; a communications link from each said signal collection unit to the computer for transmitting the data streams to the computer under the control of the computer; and a display monitor connected to and receiving output from the computer for viewing selected data and selected performance check results; characterized in that the data storage means includes reference data providing a standard of comparison against which sensed data may be compared; the computer compares the data stream or selected data extracted or calculated therefrom with the reference data or selected portions of the reference data when performing the performance checks; and the computer output to the display monitor and displayed on the display monitor includes the results of selected performance checks; wherein the display monitor is or is incorporated into a pager and is remote from the computer and is connected thereto by a telecommunications link.

4. Apparatus as defined in claim 3, wherein selected reference data is in the form of threshold values for selected parameters against which the computer compares current values of associated parameters in the course of performing selected ones of the performance checks.

5. A method of monitoring refrigeration equipment having a compressor, a condenser, an evaporator and a refrigeration chamber comprising:

(a) continuously sensing the values of selected operating parameters of the refrigeration equipment; and
(b) performing equipment checks on the sensed values to identifying existing or incipient problems with the refrigeration equipment;

wherein:

the sensed values of the operating parameters are sampled at regular intervals and the sampled values are inserted into a database to maintain a time series of the recent history of each operating parameter, each time series comprising more than one pair of values, each pair of values comprising the sampled value of an operating parameter and a value representing the point in time at which the sample was sensed and the refrigeration equipment is actively monitored for existing or incipient equipment problems by repeatedly retrieving the entire stored time series of the recent history of one or more operating parameters and tracking the trend of each said operating parameter by examining the interrelationship over time of values from each of the time series so retrieved from the database.

6. The method of claim 5 wherein the selected operating parameters include the current drawn by the compressor and the equipment checks include at least one of:

locked compressor rotor high amperage;
long compressor on-cycle;
short compressor on-cycle;
long compressor off-cycle.

7. The method of claim 5 wherein at least one of the equipment checks is performed by comparing the sensed value of an operating parameter with a suitable associated threshold value, said threshold value being calculated as a function of the time series of the recent history of the associated operating parameter during normal operation of the refrigeration equipment.

8. The method of claim 7 wherein the selected operating parameters include:

the line voltage of the electricity source;
current drawn by the compressor;
compressor intake pressure;
compressor condenser pressure; and
the refrigeration chamber temperature
and
the problems with the refrigeration equipment identified by the equipment checks include at least some of:
power outage alert;
power restored warning;
high voltage warning;
low voltage warning;
no refrigerant pressure alert;
low cut-out pressure warning;
high cut-in pressure warning;
high condenser pressure warning;
high condenser pressure alert.

9. The method of claim 8 wherein:

(a) the refrigeration equipment further includes a defroster;
(b) the selected operating parameters further include the defroster current; and
(c) the problems with the refrigeration equipment identified by the equipment checks further include a high defroster current warning and a low defroster current warning.

10. Apparatus to monitor refrigeration equipment having a compressor, a condenser, an evaporator and a refrigeration chamber comprising:

(a) one or more sensors for continuously sensing the values of selected operating parameters of the refrigeration equipment; and
(b) a monitor for performing equipment checks on the sensed values to identify existing or incipient problems with the refrigeration equipment;

wherein:

the sensed values of the operating parameters are sampled at regular intervals and the sampled values are inserted into a database to maintain a time series of the recent history of each operating parameter, each time series comprising more than one pair of values, each pair of values comprising the sampled value of an operating parameter and a value representing the point in time at which the sample was sensed and the monitor actively monitors the refrigeration equipment for existing or incipient equipment problems by repeatedly retrieving the entire stored time series of the recent history of one or more operating parameters and tracking the trend of each said operating parameter by examining the interrelationship over time of values from each of the time series so retrieved from the database.

11. The apparatus of claim 10 wherein the selected operating parameters include the current drawn by the compressor and the equipment checks include at least one of:

locked compressor rotor high amperage;
long compressor on-cycle;
short compressor on-cycle;
long compressor off-cycle.

12. The apparatus of claim 10 wherein at least one of the equipment checks is performed by comparing the sensed value of an operating parameter with a suitable associated threshold value, said threshold value being calculated as a function of the time series of the recent history of the associated operating parameter during normal operation of the refrigeration equipment.

13. The apparatus of claim 12 wherein the selected operating parameters include:

the line voltage of the electricity source;
current drawn by the compressor;
compressor intake pressure;
compressor condenser pressure; and
the refrigeration chamber temperature
and
the problems with the refrigeration equipment identified by the equipment checks include at least some of:
power outage alert;
power restored warning;
high voltage warning;
low voltage warning;
no refrigerant pressure alert;
low cut-out pressure warning;
high cut-in pressure warning;
high condenser pressure warning;
high condenser pressure alert.

14. The apparatus of claim 13 wherein:

(a) the refrigeration equipment further includes a defroster;
(b) the selected operating parameters further include the defroster current; and
(c) the problems with the refrigeration equipment identified by the equipment checks further include a high defroster current warning and a low defroster current warning.

* * * * *